US007712891B2

(12) United States Patent
Ishida et al.

(10) Patent No.: US 7,712,891 B2
(45) Date of Patent: May 11, 2010

(54) IMAGE-FORMING DEVICE

(75) Inventors: Kazuhito Ishida, Ichinomiya (JP); Teruo Deshimaru, Nagoya (JP); Tetsuo Asada, Kuwana (JP); Yukichi Sawaki, Nagoya (JP); Takashi Ohama, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 187 days.

(21) Appl. No.: 11/019,476

(22) Filed: Dec. 23, 2004

(65) Prior Publication Data

US 2005/0151782 A1 Jul. 14, 2005

(30) Foreign Application Priority Data

Dec. 26, 2003 (JP) ..... 2003-434532
Jul. 28, 2004 (JP) ..... 2004-219567

(51) Int. Cl.
*B41J 2/01* (2006.01)

(52) U.S. Cl. ..... 347/104; 347/2; 347/4

(58) Field of Classification Search ..... 347/2–4, 347/104; 358/296, 471
See application file for complete search history.

(56) References Cited

U.S. PATENT DOCUMENTS 4,704,638 A * 11/1987 Igarashi ..... 358/296
4,873,579 A * 10/1989 Kubota et al. ..... 358/471
5,150,227 A * 9/1992 Koshiyouji et al. ..... 358/497
5,814,809 A * 9/1998 Han ..... 250/208.1
5,909,226 A 6/1999 Takeda
6,113,217 A 9/2000 Araki et al.
6,802,601 B2 10/2004 Suzuki et al.
6,804,858 B2 10/2004 Yazawa et al.
7,119,933 B2 * 10/2006 Sugimoto ..... 358/474
2002/0149661 A1 * 10/2002 Konno ..... 347/104
2003/0184622 A1 10/2003 Sasaki et al.
2003/0184623 A1 10/2003 Sasaki et al.
2003/0184626 A1 10/2003 Sasaki et al.
2003/0184627 A1 10/2003 Sasaki et al.
2003/0184771 A1 10/2003 Yamamoto et al.

FOREIGN PATENT DOCUMENTS

JP A 4-213466 8/1992
JP A 2002-284455 10/2002
JP B2 3376216 11/2002
JP A 2002-356002 12/2002
JP B2 3402593 2/2003
JP U 3093658 2/2003
JP A 2003-103869 4/2003
JP A 2003-298790 10/2003

OTHER PUBLICATIONS

US 6,698,873, 03/2004, Sasaki (withdrawn)

* cited by examiner

*Primary Examiner*—Lam S Nguyen
(74) *Attorney, Agent, or Firm*—Oliff & Berridge, PLC

(57) ABSTRACT

A multifunctional device including a lower frame, a main control board, and a cartridge holder. A conveying space is formed in the lower frame farther forward than a recording unit and includes a discharge space for receiving discharged recording sheet. The main control board is disposed horizontally above the conveying space when viewed from the front. The recording unit is disposed farther rearward than the conveying space, with its topmost part substantially equal in height to the main control board. The cartridge holder is disposed to the side of the conveying space and the main control board and fits vertically within the top part.

6 Claims, 23 Drawing Sheets

IMAGE-FORMING DEVICE

BACKGROUND OF THE INVENTION

1. Field of the Invention

The present invention relates to an image-forming device for forming images on a recording medium.

2. Related Art

There have been proposed multifunctional image-forming devices that include a printer function, a facsimile function, a copier function, and the like. One such image-forming device well known in the art is provided with an inkjet printing unit on its lower frame and a flatbed scanning unit on its upper frame. The flatbed scanning unit has an image-scanning function implemented by a contact image sensor (CIS), a charge-coupled device (CCD), or the like.

For example, an image-forming device disclosed in Japanese unexamined patent application publication No. 2003-298790 includes a main casing (lower frame) formed with a discharge opening in its front side, a printing unit disposed in the main casing and including an inkjet head for ejecting ink onto a recording sheet, a backward-tilting sheet supply tray disposed on the rear side of the main casing, an ink cartridge for storing ink to be supplied to the inkjet head, and a scanner disposed on top of the main casing.

The inkjet head is a serial-type inkjet head capable of reciprocal movement in a right and left direction (widthwise direction of recording sheet) orthogonal to the front-to-rear direction in which a recording sheet is transported. In this image-forming device, a recording sheet is stacked at a downward slant in the sheet supply tray. An image is formed on the recording sheet as the sheet is conveyed in a substantially horizontal orientation past the printing unit in the main casing. The recording sheet is subsequently discharged frontward through the discharge opening. The ink cartridge is inserted through the front side of the main casing below the discharge opening.

The scanner includes a flatbed scanning unit having a close-contact type image sensor, a flatbed glass on which an original document is placed, and a cover that covers the top surface of the flatbed glass. The flatbed scanning unit is configured to pivot toward the top surface of the sheet supply tray about a pivotal axis on the rear end. The image sensor extends in a direction orthogonal to the pivotal axis and is supported on a base member positioned directly beneath the image sensor. The image sensor moves together with the base member in a direction parallel to the pivotal axis.

The image-forming device further includes a media board disposed on the side of the discharge opening. The media board is provided with media slots through which an external storage medium can be inserted.

On the other hand, an image-forming device disclosed in Japanese patent No. 3376216 has an upper frame, a lower frame, and a sheet supply tray disposed in the bottom of the lower frame. The sheet supply tray can be pulled out of the lower frame in order to stack sheets of cut paper therein. A recording sheet is conveyed to a printing unit along a conveying path that doubles back in a sideways U-shape. After an image is formed on the recording sheet in the printing unit, the sheet is discharged out of the device in a substantially horizontal orientation.

The upper frame is mounted on the lower frame so as to be able to open and close with respect to the lower frame so that pivoting the upper frame upward reveals a large area on the top surface of the lower frame. This construction facilitates operations for clearing paper jams occurring along the sheet conveying path and for replacing ink cartridges accommodated in the lower frame, as well as aids the operator in seeing the objects of these operations. A line-type image sensor in a scanning unit is configured to scan an original document one line at a time while being moved in a direction orthogonal to the pivotal axis of the upper frame.

In such image forming devices, wiring is required for transmitting signals from the scanning unit to a control board disposed in the lower frame (main casing). Since the image-forming devices disclosed in Japanese unexamined patent application publication No. 2003-298790 and Japanese patent No. 3376216 are configured so that the scanning unit or the upper frame supporting the scanning unit can open wide with respect to the lower frame (main casing) supporting the printing unit, it is necessary to prevent the wiring from getting in the way of clearing of paper jam and maintenance operations when the scanning unit or the upper frame is in an open state.

To this effect, it is preferable to connect the image sensor to the control board in the following manner. That is, the control board is disposed on the other side of the pivotal axis from the image sensor in the lower frame (main casing) just below the pivotal axis such that a side of the control board runs parallel to the pivotal axis. Then, one end of the flexible flat cable is connected to a longitudinal side of the image sensor, and the other end of the flexible flat cable is connected to the side of the control board parallel to the pivotal axis. The flexible flat cable extends in a direction in which the image sensor moves and across the pivotal axis.

SUMMARY OF THE INVENTION

However, in the image-forming device of Japanese unexamined patent application publication No. 2003-298790, in particular, a flexible flat cable with numerous wires is normally used to connect the image sensor and the control board, and this flexible flat cable is flexible enough to bend back on itself in a direction substantially parallel to the longitudinal direction of the wiring, but not flexible enough to bend back on itself in a direction orthogonal to the longitudinal direction of the wiring. When the flexible flat cable is connected between the image sensor and the control board in the above-described manner, the side of the image sensor to which the one end of the flexible flat cable is connected is orthogonal to the side of the control board to which the other end of the flexible flat cable is connected. Thus, the middle portion of the flexible flat cable is twisted about its width, and the angle of curvature in the middle portion of the flexible flat cable greatly fluctuates as the image sensor moves. When the image-forming device is used over a long period of time and the scanning unit (upper frame) is repeatedly opened and closed, repeated bending of the flexible flat cable tends to result in wearing out and breakage of the twisted portion (broken or disconnected wiring).

To eliminate twisting of the flexible flat cable, the middle portion of the cable can be bent back at right angles and the cable can be laid out orthogonal to the pivotal axis. However, even in this case, the movement of the image sensor applies a large force to the bent portions of the cable, bending these portions repeatedly and resulting in wire breakage. Hence, this problem has yet to be resolved.

Another problem is that, when the media board and the main control board are disposed at separate locations, wiring is needed to connect these two boards.

Also, since the image-forming device disclosed in Japanese unexamined patent application publication No. 2003-298790 is provided with the sheet supply tray on the rear side of the recording unit and the discharge portion and the ink cartridge on the front side thereof, the front-to-back dimension of the image-forming device is large. Further, being a serial head, the inkjet head is configured to move beyond both widthwise edges of the recording sheet, leaving wasted space on both sides of the sheet conveying path.

In the view of foregoing, it is an object of the present invention to overcome the above problems, and also to provide an image-forming device that can be made more compact by minimizing wasted internal space.

It is another object of the present invention to provide an image-forming device that facilitates maintenance and ink cartridge replacement operations by ensuring that the middle portion of a flexible flat cable does not get in the way of such operations when an upper frame supporting a scanning mechanism is opened fully, while preventing twisting in the middle portion of the cable.

It is still another object of the present invention to provide an image-forming device in which a flexible flat cable connects a scanning mechanism supported on an upper frame to a control board disposed on the opposite side of a pivotal axis of the upper frame from the scanning mechanism without bending the flexible flat cable back on itself.

In order to attain the above and other objects of the present invention, according to one aspect of the present invention, there is provided an image-forming device including a conveying mechanism that conveys a recording medium in a first direction, a recording unit that records an image on the recording medium conveyed by the conveying mechanism, a casing that accommodates the conveying mechanism and the recording unit, a control board that controls operations of the recording unit, and a cartridge accommodating unit in which an ink cartridge is accommodated. A medium conveying space is formed in the casing on one side of the recording unit with respect to the first direction. The medium conveying space has a discharge space in which the recording medium is discharged after being recorded with the image by the recording unit. The control board is horizontally disposed above the medium conveying space. A topmost part of the recording unit is positioned at substantially the same height as the control board. At least a portion of the cartridge accommodating unit is positioned on one side of the medium conveying space with respect to a second direction orthogonal to the first direction. The cartridge accommodating unit is positioned between the topmost part of the control board and a bottommost part of the medium conveying space with respect to a vertical direction.

According to a different aspect of the present invention, there is provided an image-forming device including a lower frame, an upper frame capable of pivoting open and closed with respect to the lower frame about an axis extending in a first direction, a scanning unit that is disposed in the upper frame and scans an original document while reciprocally moving in a second direction orthogonal to the first direction, and a control board having one side extending in the first direction.

BRIEF DESCRIPTION OF THE DRAWINGS

In the drawings:

FIG. 5(*b*) is a cross-sectional view of an image sensor taken along a line Vb-Vb of FIG. 5(*a*);

PREFERRED EMBODIMENTS OF THE PRESENT INVENTION

Next, preferred embodiments of the present invention will be described with reference to the accompanying drawings.

In the preferred embodiments, the present invention is applied to a multifunctional device including a printer function, a facsimile function, a copier function, and a scanner function. For the following description, the near side of a multifunctional device 1 in FIG. 1 is defined as the front, and left and right directions when viewing from the front of the multifunctional device 1 are defined as the left and right directions.

First, a multifunctional device 1 according to a first embodiment of the present invention will be described with reference to FIGS. 1 to 13.

Figure 1:
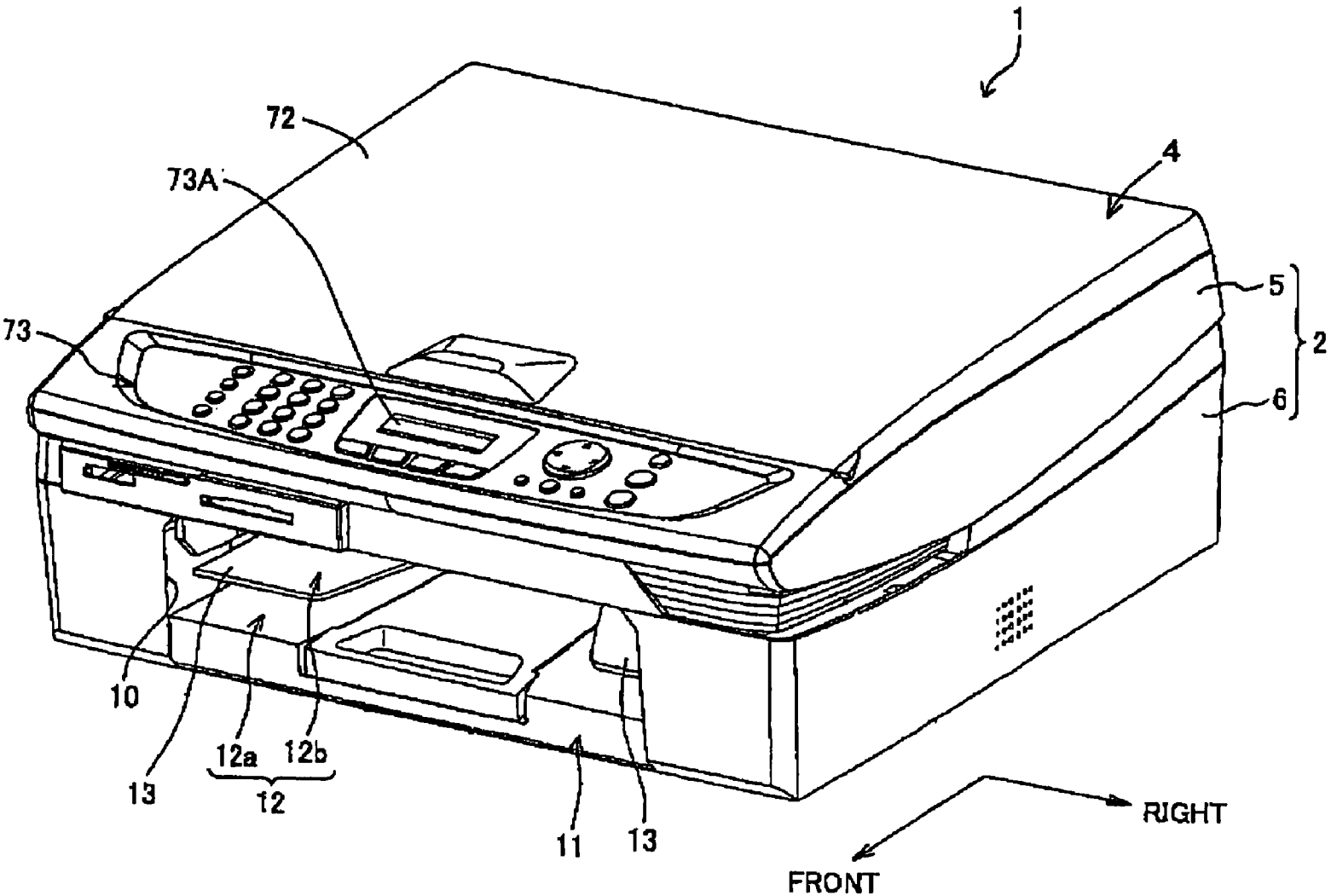
FIG. 1 is a perspective view of a multifunctional device according to a first embodiment of the present invention.

As shown in FIG. 1, the multifunctional device 1 includes a main casing 2 having an upper frame 5 and a lower frame 6. The lower frame 6 is formed in a substantially square shape in a plan view. A sheet accommodating section 10 is formed as a recess in the front bottom portion of the lower frame 6 and centered left-to-right, providing an arch-like front appearance to the lower frame 6. A conveying space 12 is defined inside the sheet accommodating section 10 for conveying a recording sheet P (see FIG. 12) in the front-to-rear direction.

A sheet supply tray 11 for holding the recording sheets P is detachably inserted into the sheet accommodating section 10 and is capable of moving in the front-to-rear direction within the conveying space 12. When accommodated in the sheet accommodating section 10, the sheet supply tray 11 blocks the bottom of the sheet accommodating section 10. In other words, by eliminating a bottom surface of the sheet accommodating section 10 and by configuring the sheet supply tray 11 to serve as the bottom surface, it is possible to reduce the height of the lower frame 6. This construction also facilitates maintenance work for paper jams and the like since the bottom of the lower frame 6 can be opened simply by removing the sheet supply tray 11 from the sheet accommodating section 10.

Guide pieces 13 formed in arch shapes are disposed near the front part of the sheet supply tray 11 to extend from the left and right edges of the sheet accommodating section 10 to cover the top of the recording sheet P loaded in the sheet supply tray 11. The guide pieces 13 determine the left-to-right position of the recording sheet P on the sheet supply tray 11. The guide pieces 13 also function as a discharge tray. After an image is formed on the recording sheet P in a recording unit 21 described later, the recording sheet P is discharged forward onto the top surfaces of the guide pieces 13. Hence, the guide pieces 13 divide the conveying space 12 into a lower supply space 12*a* for supplying the recording sheet P and an upper discharge space 12*b* for discharging the recording sheet P. Note that the guide pieces 13 have been omitted from FIGS. 2-4.

Figure 6:
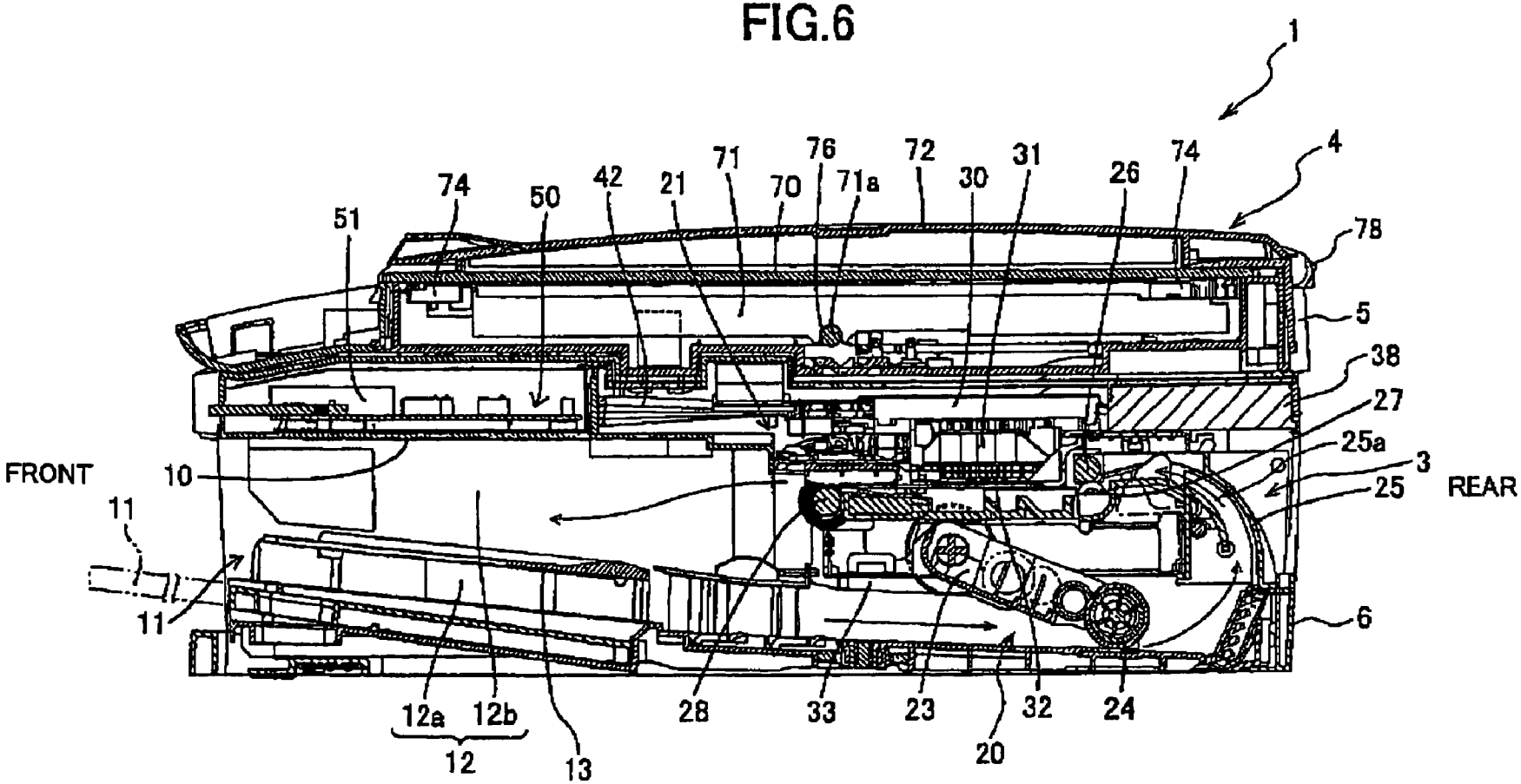
FIG. 6 is a cross-sectional view of the multifunctional device taken along a line VI-VI of FIG. 2.

As shown in FIG. 6, a printing unit 3 is accommodated in the lower frame 6. The printing unit 3 includes a conveying mechanism 20 for conveying the recording sheets P accommodated in the sheet supply tray 11 in the front-to-rear direction, and the recording unit 21 disposed in the rear section of the lower frame 6 for recording images on the recording sheets P. A cover 22 (FIG. 10) formed of a synthetic resin is mounted on the lower frame 6 for covering the conveying mechanism 20 and the recording unit 21.

As shown in FIG. 6, the conveying mechanism 20 includes an arm 23, a supply roller 24, a plate 25, a registration roller 26, a follow roller 27, and a discharge roller 28. The arm 23 is disposed above the rear end of the sheet supply tray 11 and extends downward from an engine frame 33 of the recording unit 21. The supply roller 24 is rotatably supported on the lower end of the arm 23. The plate 25 is disposed in a space in the rear of the sheet accommodating section 10 and has a U-shaped conveying part 25*a*. The registration roller 26 is disposed at a position farther forward than the plate 25 and farther rearward than the recording unit 21. The follow roller 21 is disposed in opposition to the registration roller 26. The discharge roller 28 is disposed in the front section of the recording unit 21. A motor (not shown) drives each of the supply roller 24, the registration roller 26, and the discharge roller 28 to rotate.

Operations of the conveying mechanism 20 for conveying a recording sheet P will be described. First, the supply roller 24 picks up a recording sheet P from the sheet supply tray 11 one sheet at a time and conveys the recording sheet P to the U-shaped conveying part 25*a* formed in the plate 25. The recording sheet P is flipped over in the U-shaped conveying part 25*a* so as to be moving forward and is conveyed to the recording unit 21 by the registration roller 26 and the follow roller 27. After the recording unit 21 records an image on the recording sheet P, the recording sheet P is discharged into the upper discharge space 12*b* by the discharge roller 28. Since the recording sheet P supplied from the front is inverted by the U-shaped conveying part 25*a* and discharged toward the front, the front-to-rear dimension of the multifunctional device 1 can be made shorter than a multifunctional device configured to feed a recording sheet P from the rear and discharge the recording sheet P toward the front.

Figure 8:
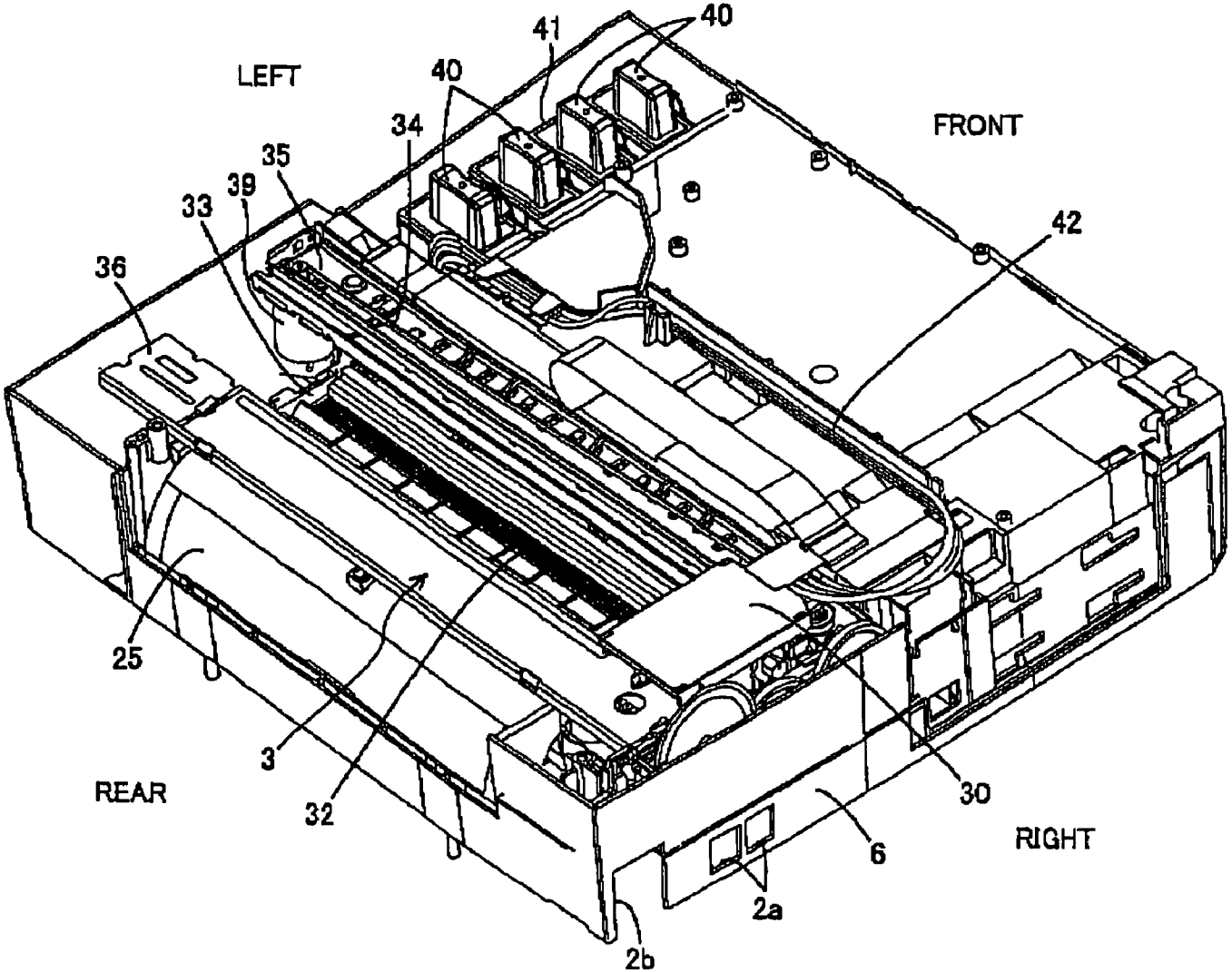
FIG. 8 is a perspective view showing the internal components of the main casing.

As shown in FIGS. 6 and 8, the recording unit 21 includes a carriage 30, an inkjet head 31, a platen 32, the engine frame 33, a timing belt 34, and a motor 39. The inkjet head 31 is attached to the bottom section of the carriage 30. The platen 32 is disposed below the carriage 30. The engine frame 33 supports the carriage 30 and the platen 32. A pair of front and rear guide plates 35 and 36 extending left-to-right are disposed above the engine frame 33. The carriage 30 is coupled with the motor 39 via the timing belt 34 and can be moved reciprocatingly left and right over the guide plates 35 and 36 to positions beyond both widthwise edges of the recording sheet P.

With this construction, the motor 39 moves the carriage 30 reciprocatingly left and right along the pair of guide plates 35 and 36, while ink is ejected from the inkjet head 31 disposed on the carriage 30 onto the recording sheet P being conveyed forward in the space below the inkjet head 31. In this manner, an image is formed on the recording sheet P.

Figure 12:
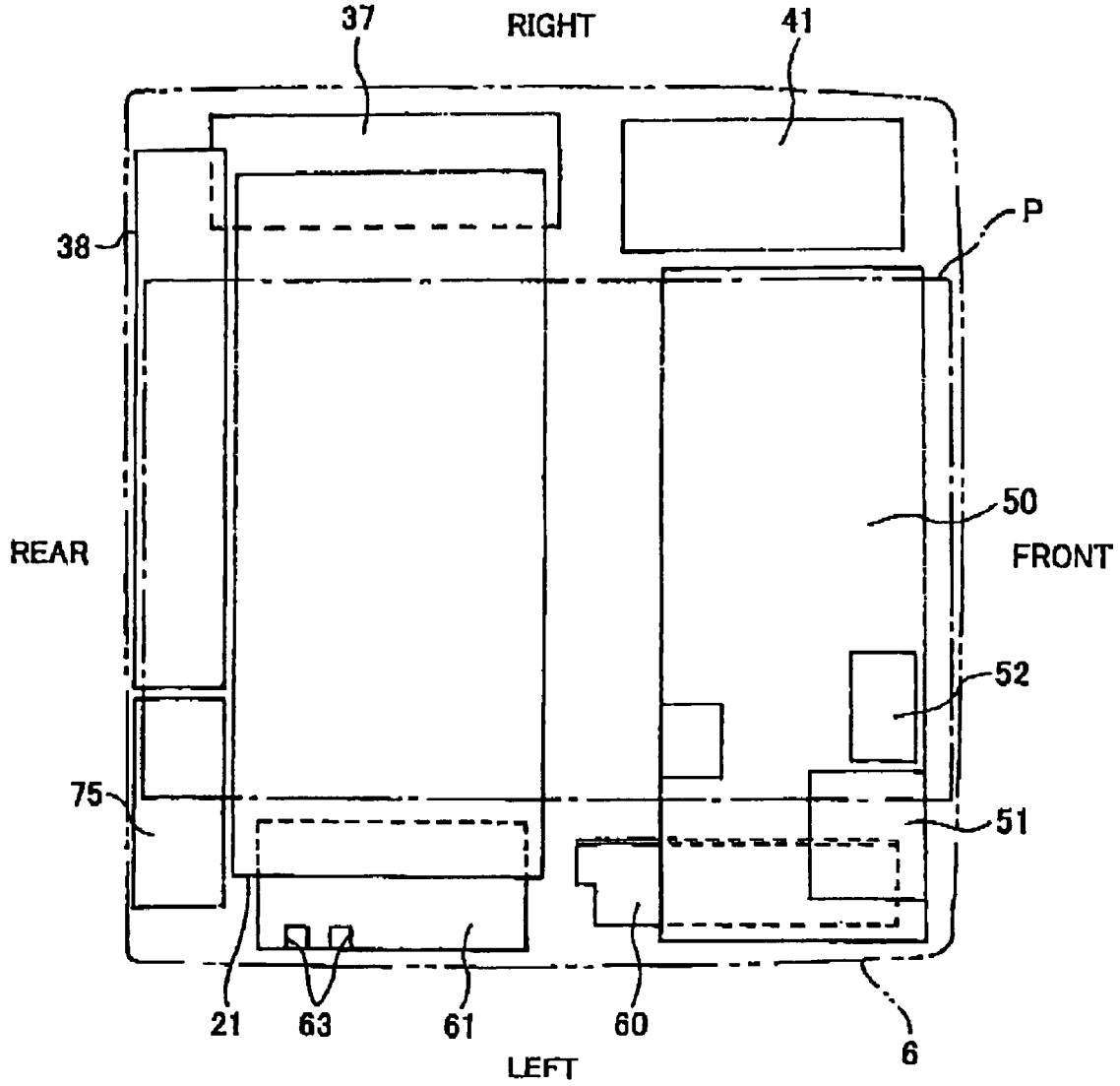
FIG. 12 is a schematic plan view of the multifunctional device.

As shown in FIG. 12, a maintenance unit 37 for cleaning the inkjet head 31 is provided below the right edge of the recording unit 21.

Since a U-shaped conveying path through which a recording sheet P is conveyed from the lower supply space 12*a* to the upper discharge space 12*b* is disposed below the inkjet head 31, unused space exists above the plate 25 that forms the U-shaped conveying part 25*a* of the U-shaped conveying path, and behind the carriage 30 mounted with the inkjet head 31. Therefore, as shown in FIGS. 6 and 12, a waste liquid absorbing member 38 is disposed in the space above the plate 25 and behind the carriage 30, occupying approximately the right two-thirds of the space. The waste liquid absorbing member 38 is for absorbing waste ink discharged from nozzles in the inkjet head 31 when the maintenance unit 37 performs maintenance operations. This makes effective use of the space in the lower frame 6.

Figure 11:
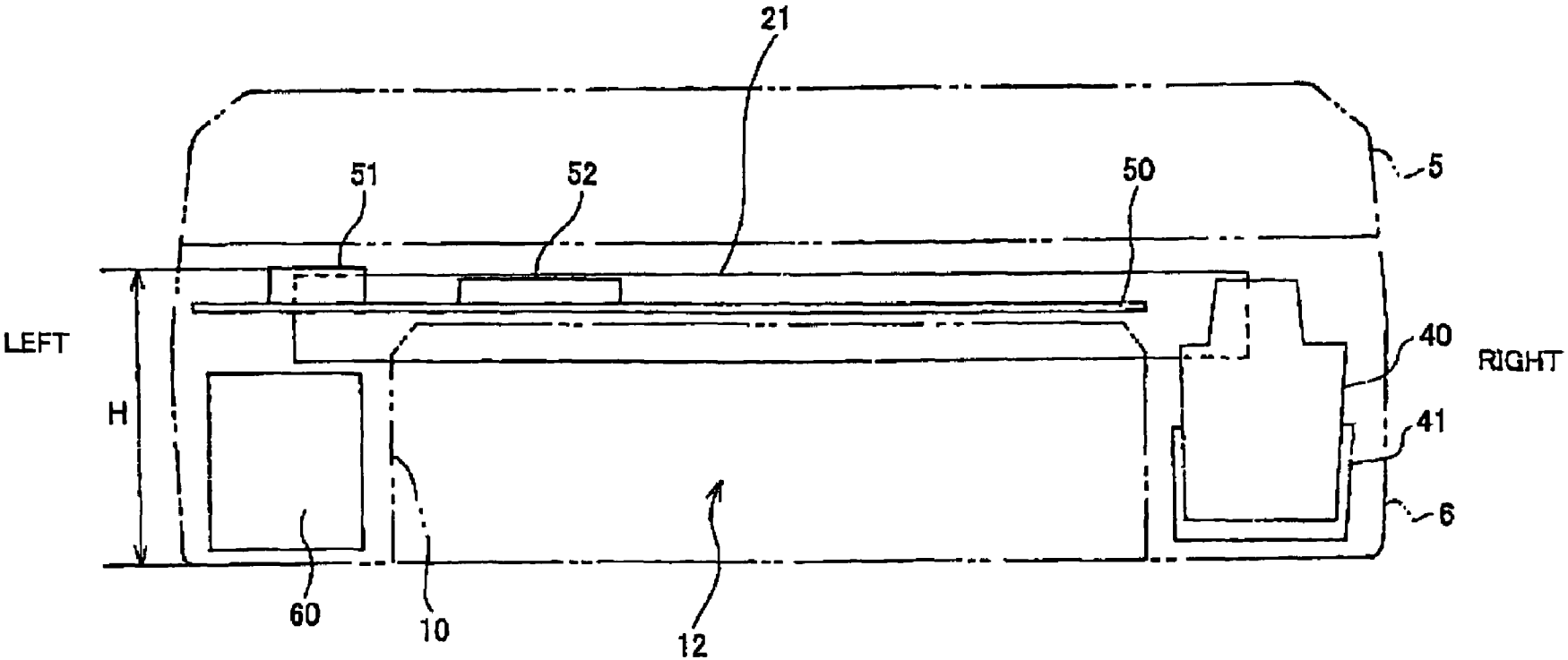
FIG. 11 is a schematic front view of the multifunctional device showing the arrangement of the primary components.

As described above, the inkjet head 31 is a serial head capable of moving beyond both widthwise edges of the recording sheet P. Hence, as shown in FIG. 11, the recording unit 21 extends further in the left and right directions than the sheet accommodating section 10, thereby forming spaces on the left and right sides of the sheet accommodating section 10. Therefore, in the present embodiment, a cartridge holder 41 for holding ink cartridges 40 is disposed on the right side of the sheet accommodating section 10, and a power supply unit 60 is disposed on the left side of the sheet accommodating section 10, thereby making effective use of the spaces on both sides of the sheet accommodating section 10.

In order to discharge the recording sheet P into the upper discharge space 12*b* as shown in FIG. 6, the ceiling of the upper discharge space 12*b* (sheet accommodating section 10) need only be higher than the position at which the recording sheet P is discharged from the recording unit 21 (the top point of the discharge roller 28). Hence, the upper discharge space 12*b* need not be formed unnecessarily high. Therefore, as shown in FIG. 6, a main control board 50 for controlling operations of the multifunctional device 1 is disposed horizontally in a space above the sheet accommodating section 10. Also, the recording unit 21 is disposed behind the sheet accommodating section 10 such that the top portion of the recording unit 21 is substantially the same height as the main control board 50. In other words, the top of the main control board 50 and the top of the recording unit 21 are positioned in approximately the same plane as shown in FIG. 11. Accordingly, the space above the sheet accommodating section 10 is effectively used, while not increasing the height of the multifunctional device 1. Further, as shown in FIG. 11, the cartridge holder 41, the ink cartridges 40, and the power supply unit 60 fit vertically between the top of the main control board 50 (a connector 51 disposed on the main control board 50) and the bottom of the sheet accommodating section 10, indicated by "H" in FIG. 11. Hence, the height of the multifunctional device 1 can be made small, enabling the multifunctional device 1 to be made even more compact.

The cartridge holder 41, the main control board 50, and the power supply unit 60 will be described further.

Figure 3:
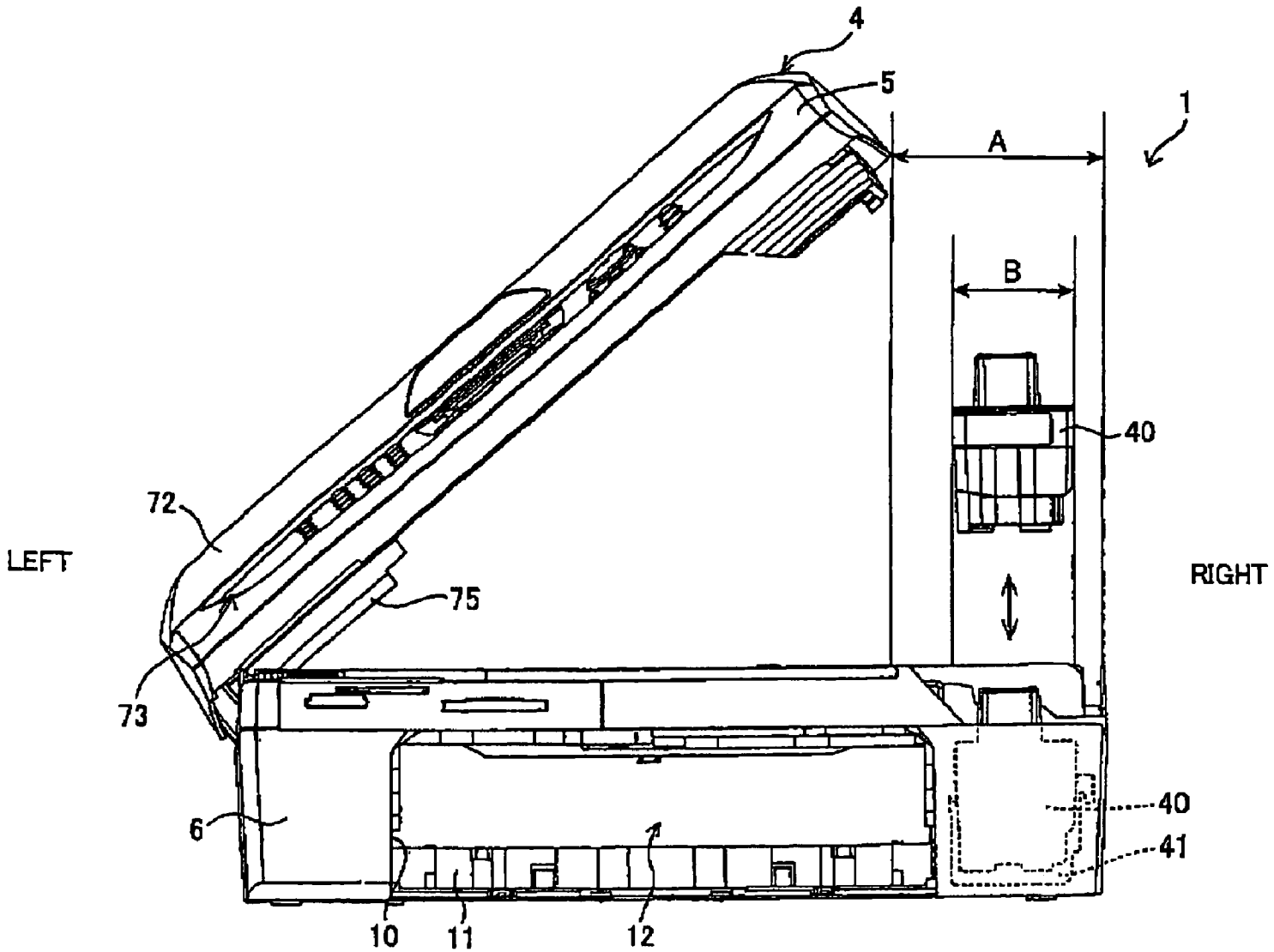
FIG. 3 is a front view of the multifunctional view of FIG. 1 with an upper frame in a wide open state.
Figure 10:
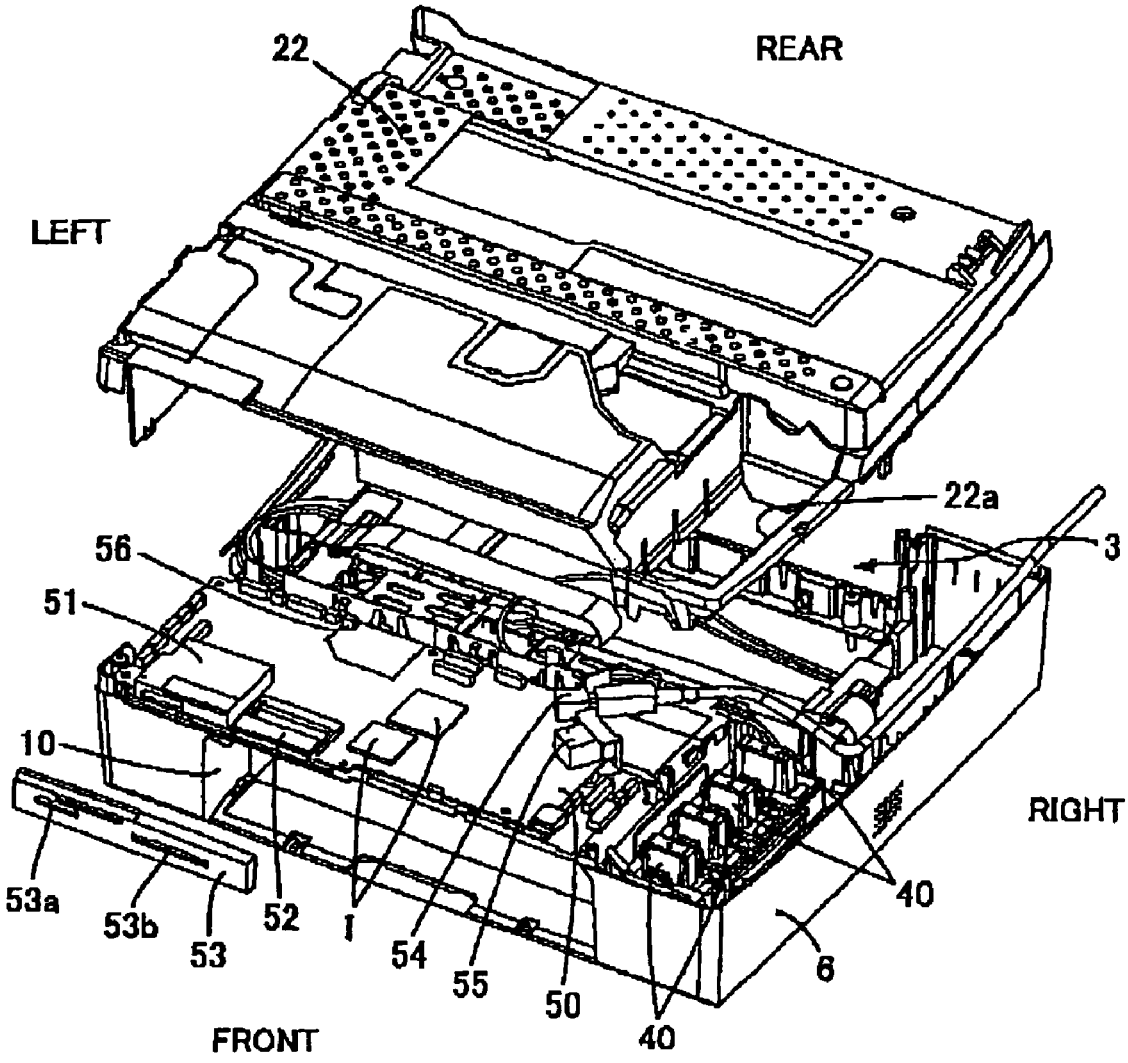
FIG. 10 is an exploded perspective view showing the main casing and a cover.

As illustrated in FIGS. 3 and 10, four ink cartridges 40, each accommodating ink for one of four colors (yellow, magenta, cyan, and black), are inserted into the cartridge holder 41 from the top of the cover 22 via an insertion hole 22*a* formed in the cover 22 and are aligned in the front-to-rear direction. The ink cartridges 40 are connected to the inkjet head 31 via flexible tubes 42 shown in FIG. 8. When ink is ejected from the inkjet head 31, ink is supplied to the inkjet head 31 from the ink cartridges 40 via the flexible tubes 42. Note that while the ink cartridges 40 in this embodiment accommodate ink of the four colors black, cyan, magenta, and yellow, the ink cartridges 40 may accommodate ink for more colors.

Figure 4:
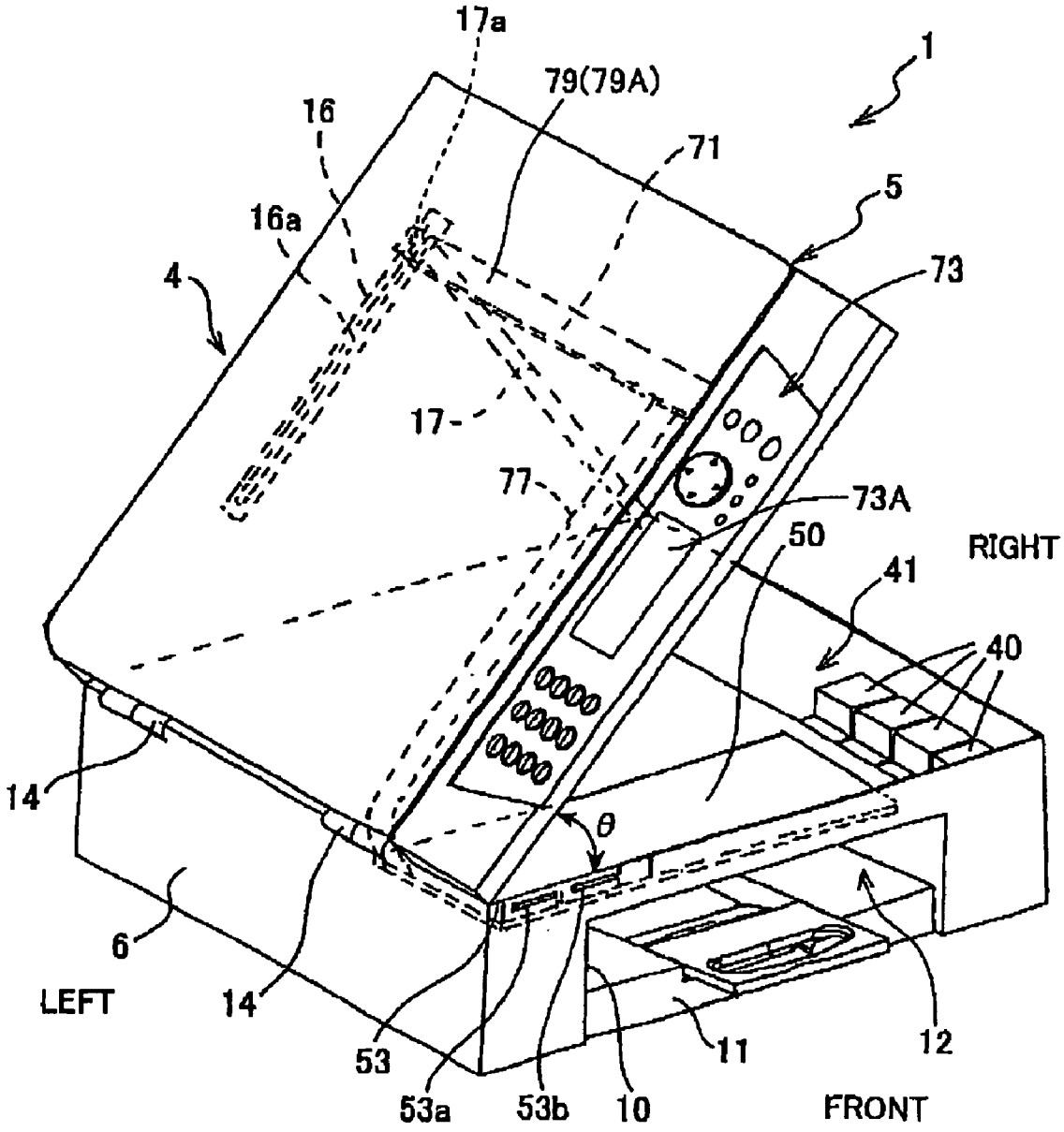
FIG. 4 is a perspective view of the multifunctional device of FIG. 1 with the upper frame in a wide open state.

As shown in FIG. 4, the upper frame 5 is pivotably supported on the left edge of the lower frame 6 via shafts 14, such as hinges. In other words, when viewed from the front of the multifunctional device 1, the upper frame 5 can pivot open sideways about the side edge opposite the position of the cartridge holder 41. Pivoting the upper frame 5 in this way reliably reveals the top of the cartridge holder 41, enabling ink cartridges 40 to be easily mounted into the cartridge holder 41 from above.

A guide rail 16 extending in the left-to-right direction is fixed to the bottom surface in the rear portion of the upper frame 5. The guide rail 16 is formed with a guide groove 16*a* extending left-to-right. A support rod 17 is pivotably attached to the lower frame 6 so as to be able to pivot about its lower right end. A guide pin 17*a* is provided on the free end of the support rod 17. The guide pin 17*a* is slidably engaged with the guide groove 16*a*. By sliding the guide pin 17*a* in the guide groove 16*a* until the guide pin 17*a* is fitted into an engaging part (not shown) formed in the right end of the guide groove 16*a* (the end opposite the pivotal axis of the upper frame 5, which extends in the front-to-rear direction), the support rod 17 supports the upper frame 5 in an open state. With this construction, the upper frame 5 can be maintained in an open state with respect to the lower frame 6 at a large included angle θ.

The means for holding the upper frame 5 at a large included angle θ with respect to the lower frame 6 may include arced guard rails disposed near the shafts 14 and guide pins that are guided by these rails. In addition to this, urging means may be provided for urging the upper frame 5 upward in order to maintain the upper frame 5 in the open state.

With this construction, the top surface of the lower frame 6 can be opened wide, improving visibility and facilitating such operations as maintenance of the inkjet head 31 and the like, clearing of paper jams along the conveying path, and replacing of the ink cartridges 40. As shown in FIG. 3, if a distance A between the tight edge of the upper frame 5 in its uppermost position and the right edge of the lower frame 6 when viewed from the front is set either equal to or greater than a width dimension B of the ink cartridges 40, then the ink cartridges 40 can be almost vertically lifted out of or inserted into the cartridge holder 41 on the side of the lower frame 6, improving visibility and facilitating mounting and removal operations of the ink cartridges 40.

As shown in FIG. 11, the main control board 50 has a flat substantially rectangular shape and extends to the left side above the power supply unit 60. Accordingly, even when a main control board 50 having a relatively large surface area is required due to a large number of electronic parts or terminals mounted thereon, for example, the main control board 50 can still be disposed above the sheet accommodating section 10 by extending the main control board 50 over the power supply unit 60. Hence, the multifunctional device 1 can be made compact by effectively using the space above the sheet accommodating section 10. Also, because the power supply unit 60 is positioned nearly directly below the main control board 50, a wire connecting the main control board 50 and the power board 62 can be very short.

On the other hand, the main control board 50 does not extend to the right above the cartridge holder 41 so that the main control board 50 does not hinder operations for mounting the ink cartridges 40 into the cartridge holder 41 from above.

As shown in FIG. 10, electronic parts I and various connectors are provided on the main control board 50. Specifically, two connectors 51 and 52 for connecting to a media card are disposed in the front left region of the main control board 50. A front cover 53 is disposed on the front surface of the lower frame 6. The front cover 53 is formed with two slots 53*a* and 53*b* through which media cards are inserted. The media cards inserted into the slots 53*a* and 53*b* form an electrical connection with the respective connectors 51 and 52 on the main control board 50. Since the main control board 50 is disposed above the sheet accommodating section 10 as shown in FIG. 11, the slots 53*a* and 53*b* (and the connectors 51 and 52) are disposed at a relatively high position, facilitating insertion of the media cards in the slots 53*a* and 53*b*.

As shown in FIG. 10, a connector 54 for connecting to a personal computer or other external device and a LAN connector 55 for connecting to a LAN are disposed on the rear right region of the main control board 50. Further, a connector 56 for connecting to a network board 61 described later is mounted on the rear left region of the main control board 50. A plurality of other connectors is also provided along the peripheral edge of the main control board 50.

Figure 9:
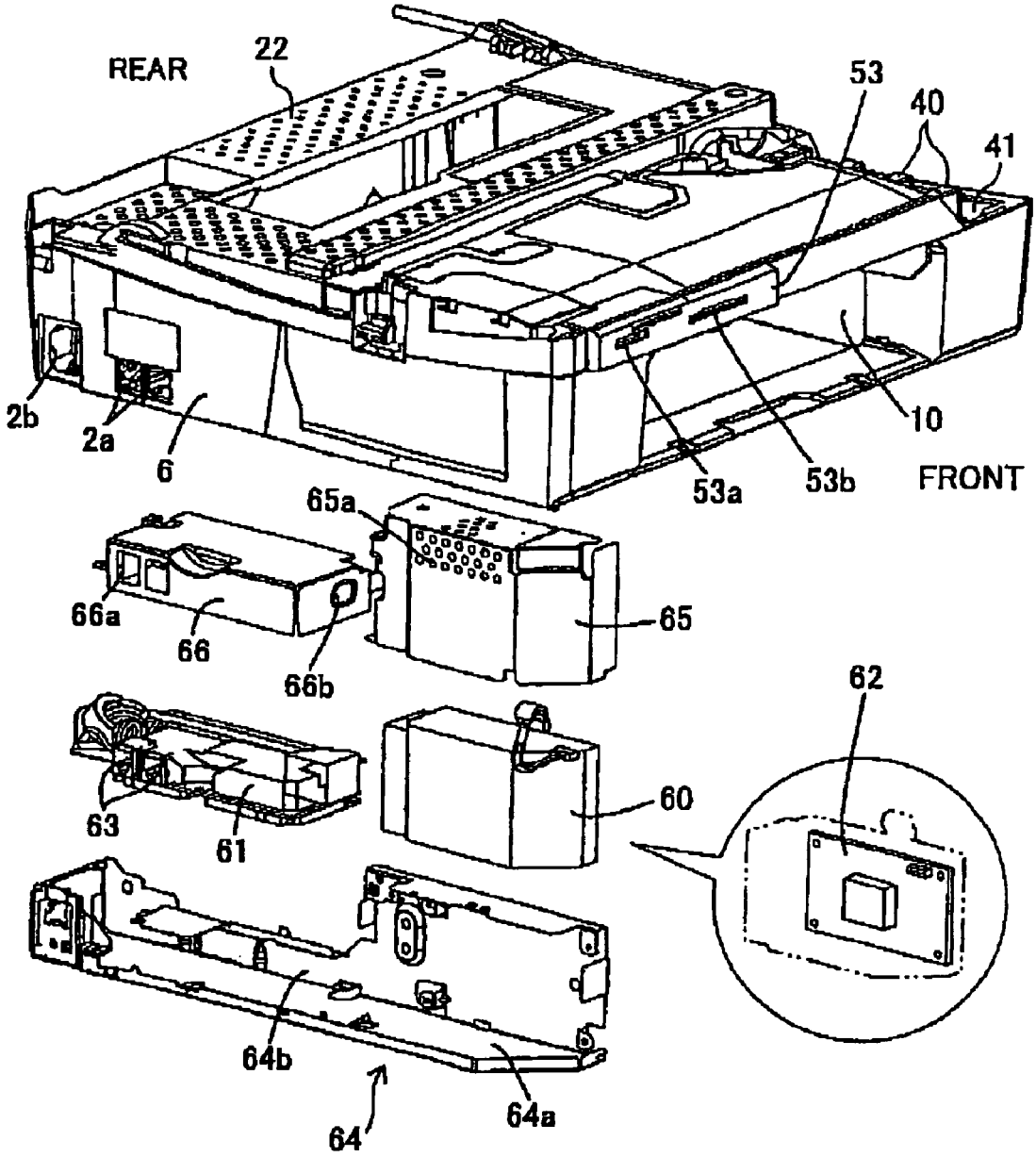
FIG. 9 is an exploded perspective view showing the main casing, a power supply unit, and a network board.

As shown in FIG. 9, the power supply unit 60 has a block shape elongated in the front-to-rear direction. The power supply unit 60 houses a power board 62 that uses commercial AC power sources to generate 5 volt DC power used to power a CPU, a memory, and the like, and 30 volt DC power for operating motors and other actuators. Wiring materials (not shown) connect the power board 62 to the main control board 50 or the power board 62 to various motors so that voltages generated by the power board 62 can be applied to the main control board 50 and the motors.

Figure 13:
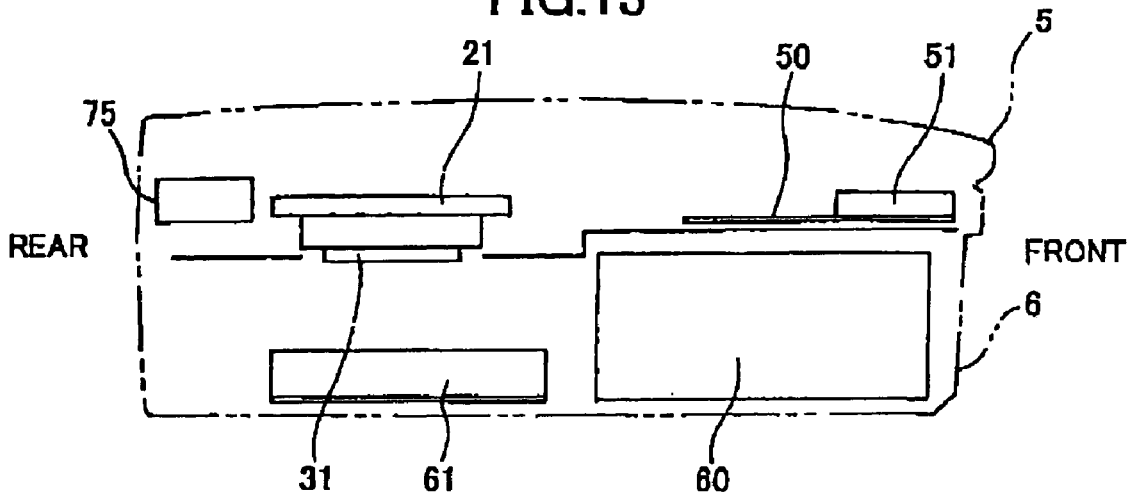
FIG. 13 is a schematic left side view of the multifunctional device.

As shown in FIGS. 12 and 13, the network board 61 is disposed in a space behind the power supply unit 60 and below the left edge of the recording unit 21. The network board 61 is a circuit board functioning to perform wired communications via a telephone line. As shown in FIG. 9, two modular connectors 63 are provided on the network board 61 for connecting to a telephone line and an external handset. Hence, the network board 61 enables data communications with another facsimile device and a phone call using the external handset (not shown).

The power supply unit 60 and the network board 61 are both mounted on a metal plate fixture 64 and attached to the lower frame 6 as an integral unit. The plate fixture 64 has a flat base 64*a* extending in the front-to-rear direction, and a side wall 64*b* disposed along rear and right edges of the flat base 64*a*. The power supply unit 60 is mounted in the front area of the plate fixture 64, while the network board 61 is mounted in the rear area. Special protective covers 65 and 66 are mounted over the power supply unit 60 and the network board 61, respectively. A plurality of holes 65*a* are formed in the protective cover 65 in order to release heat generated by the power supply unit 60. Escape holes 66*a* are formed in the protective cover 66 at positions opposing the modular connectors 63. An opening 66*b* is formed in the protective cover 66 at a position facing the power supply unit 60, enabling the passage of the electric wires used to connect the main control board 50.

An opening (not shown) is formed in the bottom surface of the lower frame 6 on the left side of the sheet accommodating section 10, and the integrated power supply unit 60 and the network board 61 are mounted in the lower frame 6 through the opening. Hence, it is possible to remove the power supply unit 60 and the network board 61 from the lower frame 6 alone, facilitating maintenance. Insertion slots 2*a* are formed in the left wall of the lower frame 6 at points opposing the modular connectors 63 of the network board 61 for inserting modular jacks. A cord outlet 2*b* is formed in the same side of the lower frame 6 rearward of the insertion slots 2*a* for running a power cord out of the device.

As shown in FIG. 4, a control panel 73 is disposed in the front area on top of the upper frame 5, and a scanner 4 is disposed in the area behind the control panel 73. The control panel 73 includes various buttons, such as the numerical buttons 0-9, a Start button, and function buttons that can be pressed to perform various operations. The control panel 73 is also provided with a display portion 73A, such as a liquid crystal display, for displaying settings for the multifunctional device 1, messages, or the like according to need.

The scanner 4 functions to scan images from a facsimile original to be transmitted to another facsimile device when using the facsimile function, or images of an original to be copied when using the copier function. As shown in FIG. 6, the scanner 4 includes a glass plate 70 mounted on the upper frame 5 to support original documents, a scanning unit 71 for scanning images of documents placed on the glass plate 70, and a document cover 72 for covering the glass plate 70. The scanning unit 71 is disposed directly below the glass plate 70 so that the glass plate 70 is interposed between the scanning unit 71 and an original document placed on the top surface of the glass plate 70.

Figure 5A:
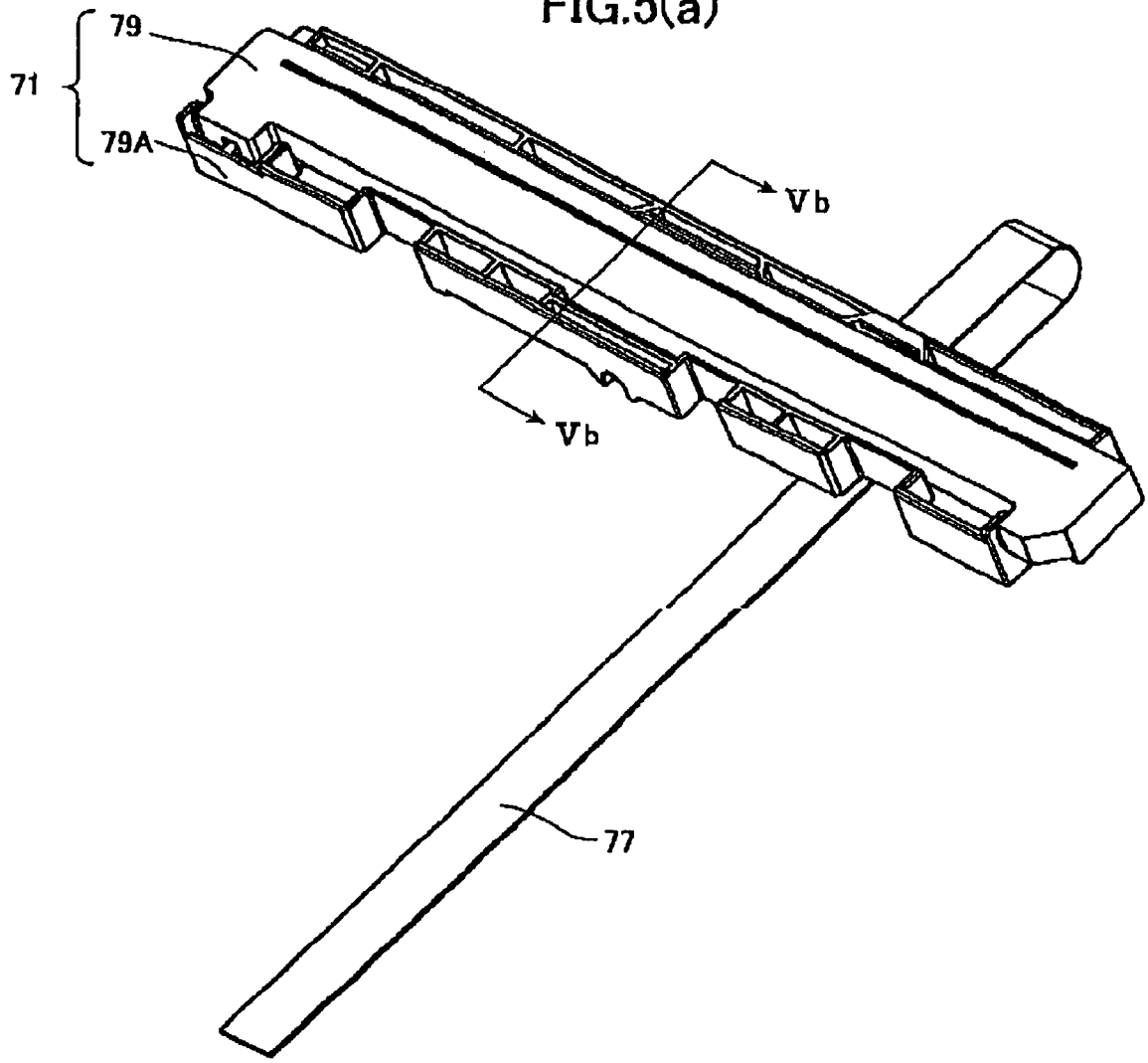
FIG. 5(*a*) a perspective view of main components of a scanning unit of the multifunctional device of FIG. 1.
Figure 5B:
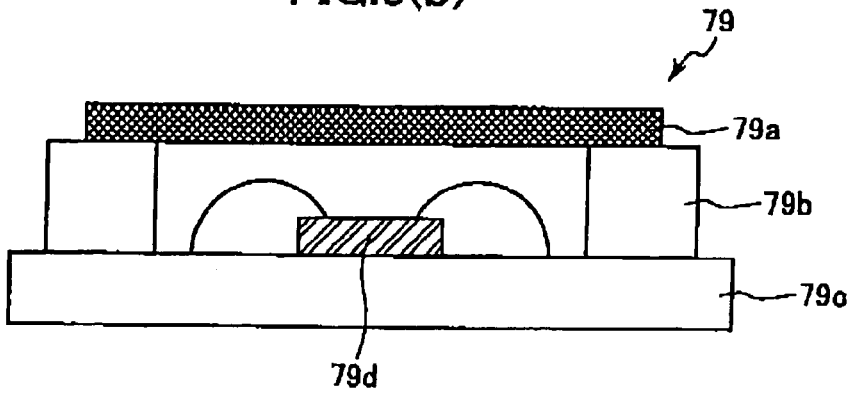

As shown in FIG. 5(*a*), the scanning unit 71 includes a line-type contact image sensor (CIS) 79 and a frame 79A on which the contact image sensor 79 is supported. The frame 79A and the contact image sensor 79 extend in the front-to-rear direction parallel to the shafts 14. As shown in FIG. 5(*b*), the contact image sensor 79 has a cover glass 79*a*, a frame 79*b*, a substrate 79*c*, and a plurality of photoelectric conversion elements 79*d* (only one photoelectric conversion element 79*d* is shown in FIG. 5(*b*)). The photoelectric conversion elements 79*d* are for reading images from the surface of the document on the glass plate 70. The photoelectric conversion elements 79*d* are aligned in the longitudinal direction of the contact image sensor 79, that is, in the front-to-rear direction of the multifunctional device 1.

As shown in FIG. 6, sliders 74 are disposed on the front and rear ends of the scanning unit 71. The scanning unit 71 is coupled with a drive motor 75 shown in FIG. 12 and scans images of a document on the glass plate 70 while the drive motor 75 and a timing belt (not shown) move the scanning unit 71 reciprocatingly left and right with respect to the upper frame 5 via the sliders 74. Also, as shown in FIG. 6, a depression 71*a* is formed on the bottom of and in the front-to-rear center portion of the scanning unit 71. A guide shaft 76 extending in the left-to-right direction is fitted into the depression 71*a* for guiding the scanning unit 71 left and right. In other words, the frame 79A with the contact image sensor 79 mounted thereon is capable of moving reciprocatingly in a direction perpendicular to the shafts 14.

As shown in FIG. 4, a flexible wiring member 77, such as a flexible flat cable, connects the contact image sensor 79 to the main control board 50. Here, the main control board 50 extends to a point near the pivotal axis of the upper frame 5 (the left edge of the lower frame 6), while the wiring member 77 extends from a portion of the main control board 50 near the pivotal axis of the upper frame 5 to the scanning unit 71.

Specifically, one end of the wiring member 77 is connected to a mid-portion of the contact image sensor 79 in the longitudinal direction, while the other end is connected to the left edge of the main control board 50 parallel to the shafts 14. The wiring member 77 runs around the periphery of the shaft 14 so that the flat surface (widthwise surface) of the wiring member 77 confronts the pivotal axis of the upper frame 5 and so that the longitudinal direction of the wiring member 77 is orthogonal to the pivotal axis of the upper frame 5 and parallel to the direction in which the contact image sensor 79 moves. The edges at both connecting ends of the wiring member 77 are arranged parallel to the pivotal axis of the upper frame 5.

With the wiring member 77 configured in this way, the widthwise surface of the wiring member 77 includes a large curved section near the shaft 14 that is not twisted when the upper frame 5 is closed over the lower frame 6 or when the upper frame 5 is opened wide. Hence, the widthwise surface of the wiring member 77 at a midpoint in the longitudinal direction does not twist, even when the contact image sensor 79 is in a standby position, that is, near the shafts 14. Accordingly, an unreasonable force is not applied to the wiring member 77, making it possible to minimize the potential for damage to the wiring member 77, even when the multifunctional device 1 is used over a long period of time and the upper frame 5 is repeatedly opened and closed. There is also no repeated bending of the wiring member 77 that can cause the wiring member 77 to wear out and break (fractures in the conducting portions). Further, the length of the wiring member 77 can be shortened greatly.

As shown in FIG. 6, the document cover 72 is pivotably attached to the rear end of the upper frame 5 via hinges 78. Hence, in a plan view, the pivotal axis of the upper frame 5 with respect to the lower frame 6 is orthogonal to the pivotal axis of the document cover 72 with respect to the upper frame 5. Therefore, when the upper frame 5 is pivoted open on the lower frame 6, the document cover 72 is prevented from opening simultaneously.

Figure 2:
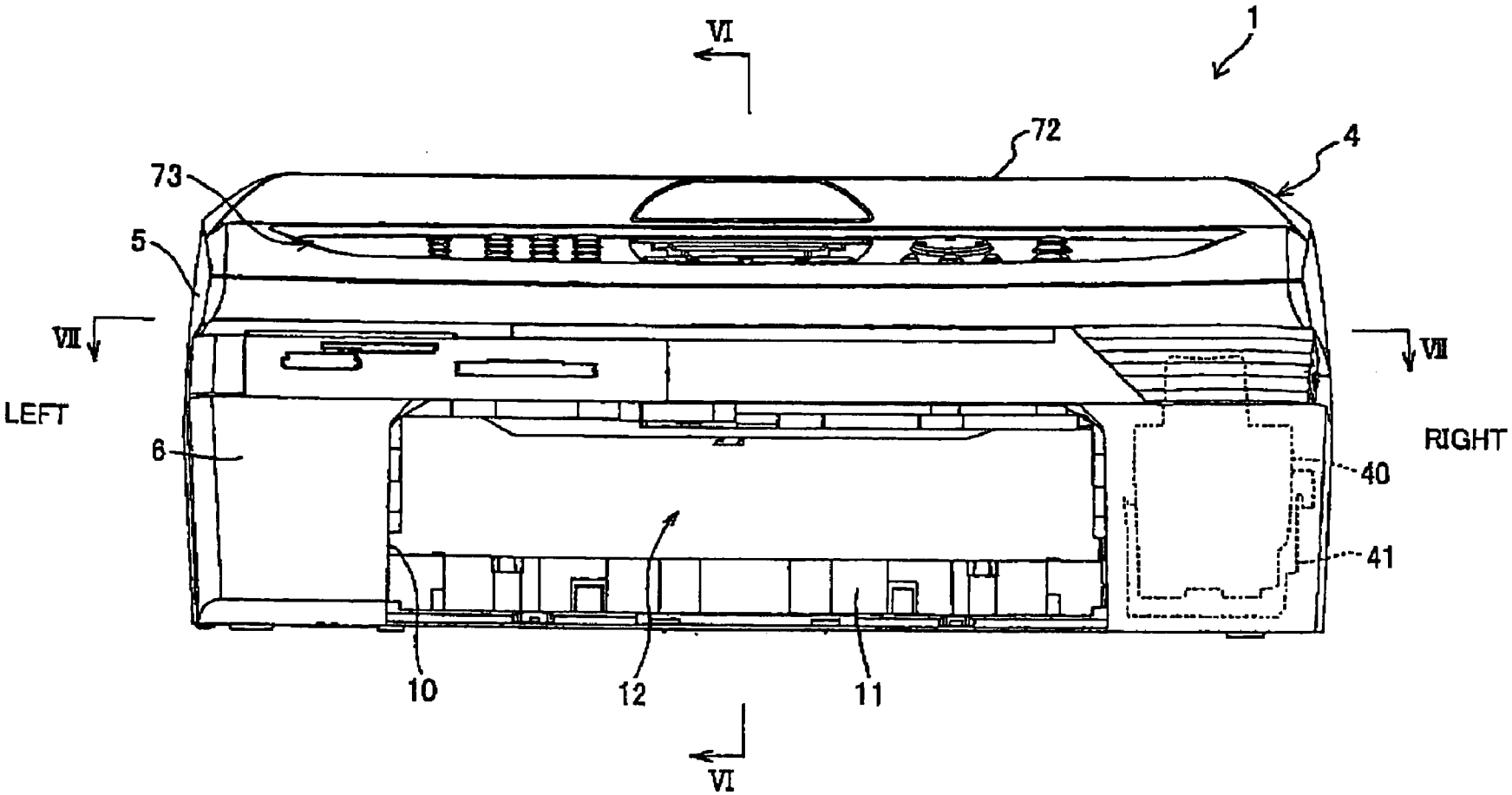
FIG. 2 is a front view of the multifunctional device of FIG. 1.
Figure 7:
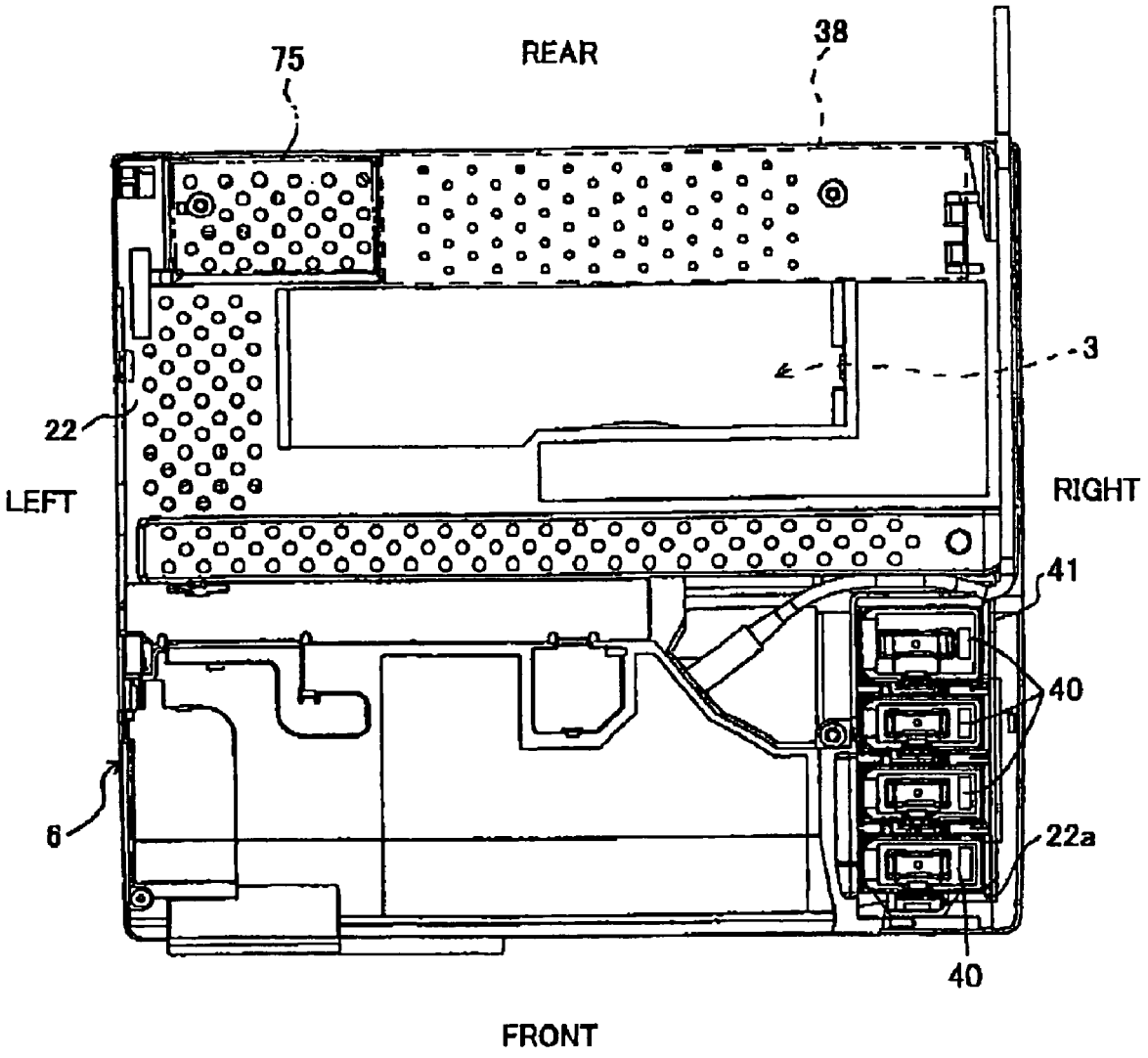
FIG. 7 is a plan view of the multifunctional device taken along a line VII-V11 of FIG. 2.

As shown in FIG. 3, the drive motor 75 is accommodated in a portion protruding downward from the left rear of the upper frame 5, so the drive motor 75 protrudes downward from the bottom of the upper frame 5. When the upper frame 5 is in the closed state as shown in FIG. 2, the drive motor 75 occupies approximately one-third of the space on the left side above the plate 25 (the recessed portion adjacent to the waste liquid absorbing member 38) as shown in FIG. 7, thereby effectively using the space behind the recording unit 21. Since the main control board 50 is disposed in the front of the main casing 2 while the drive motor 75 is disposed in the rear, adverse effects of noise generated when operating the drive motor 75 on the main control board 50 can be minimized.

Next, a multifunctional device 1A according to a modification of the first embodiment will be described with reference to FIGS. 14 to 16, wherein like parts and components have been given the same reference numerals to avoid duplicating description.

Figure 14:
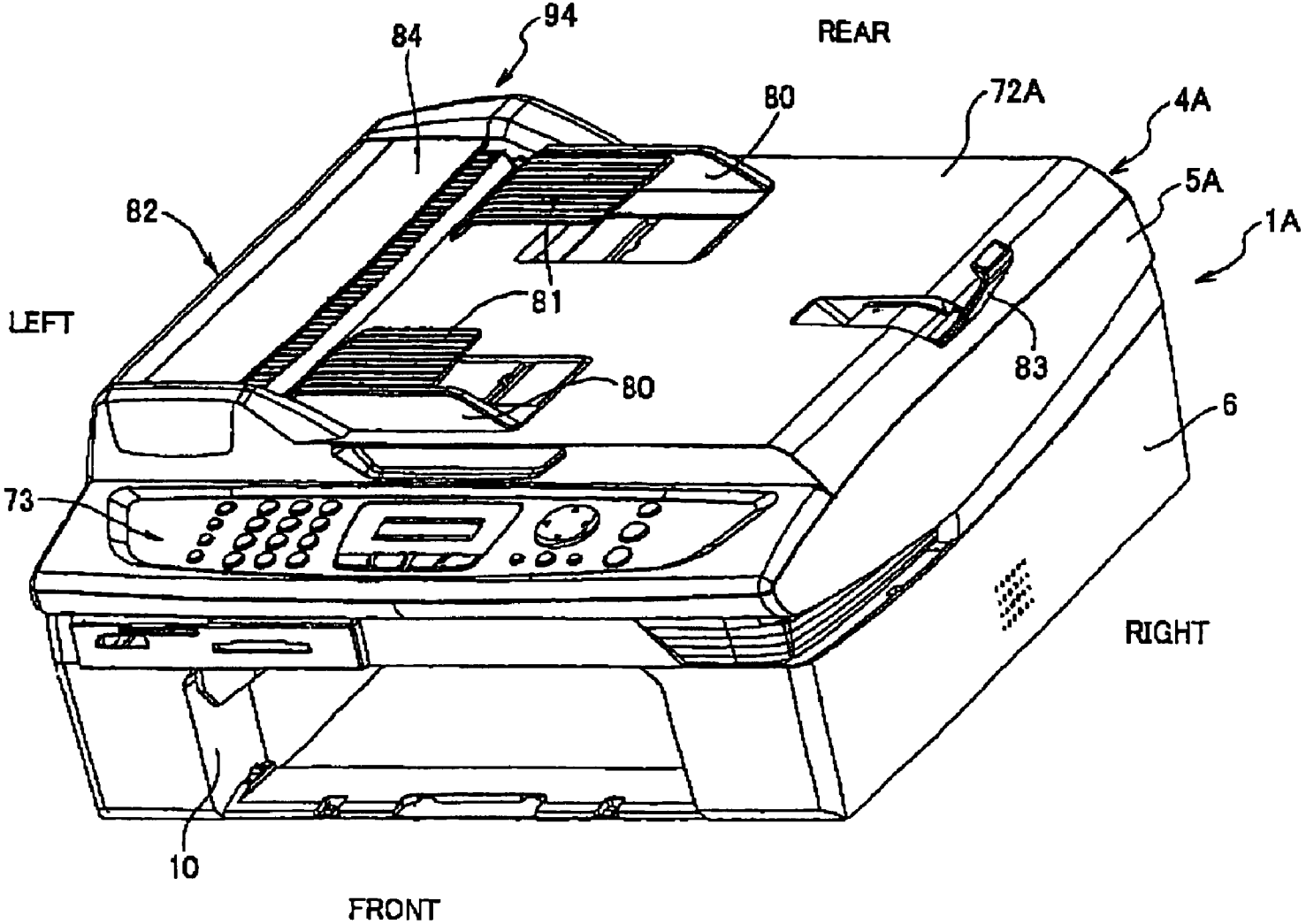
FIG. 14 is a perspective view of a multifunctional device according to a modification of the first embodiment.

As shown in FIG. 14, the multifunctional device 1A includes an upper frame 5A and a scanner 4A. The upper frame 5A is pivotably supported on the left end of the lower frame 6 in the same manner as the upper frame 5 of the first embodiment. The scanner 4A includes a document cover 72A, a document supply tray 80, a discharge tray 81, and an automatic document feeder 82.

The document cover 72A is pivotably attached to the rear edge of the upper frame 5A. The document supply tray 80 is disposed on the top surface of the document cover 72A, and the discharge tray 81 is disposed above the document supply tray 80. The document supply tray 80 guides an original document into the automatic document feeder 82 on the left.

The automatic document feeder 82 automatically conveys an original document from the document supply tray 80 to a scanning position to be scanned by the scanning unit 71. After the scanning unit 71 scans an image from the document, the document is discharged onto the discharge tray 81, and the discharge tray 81 guides the original document toward the right. A document stopper 83 is disposed on the right edge of the document cover 72A for receiving the discharged documents.

Figure 15:
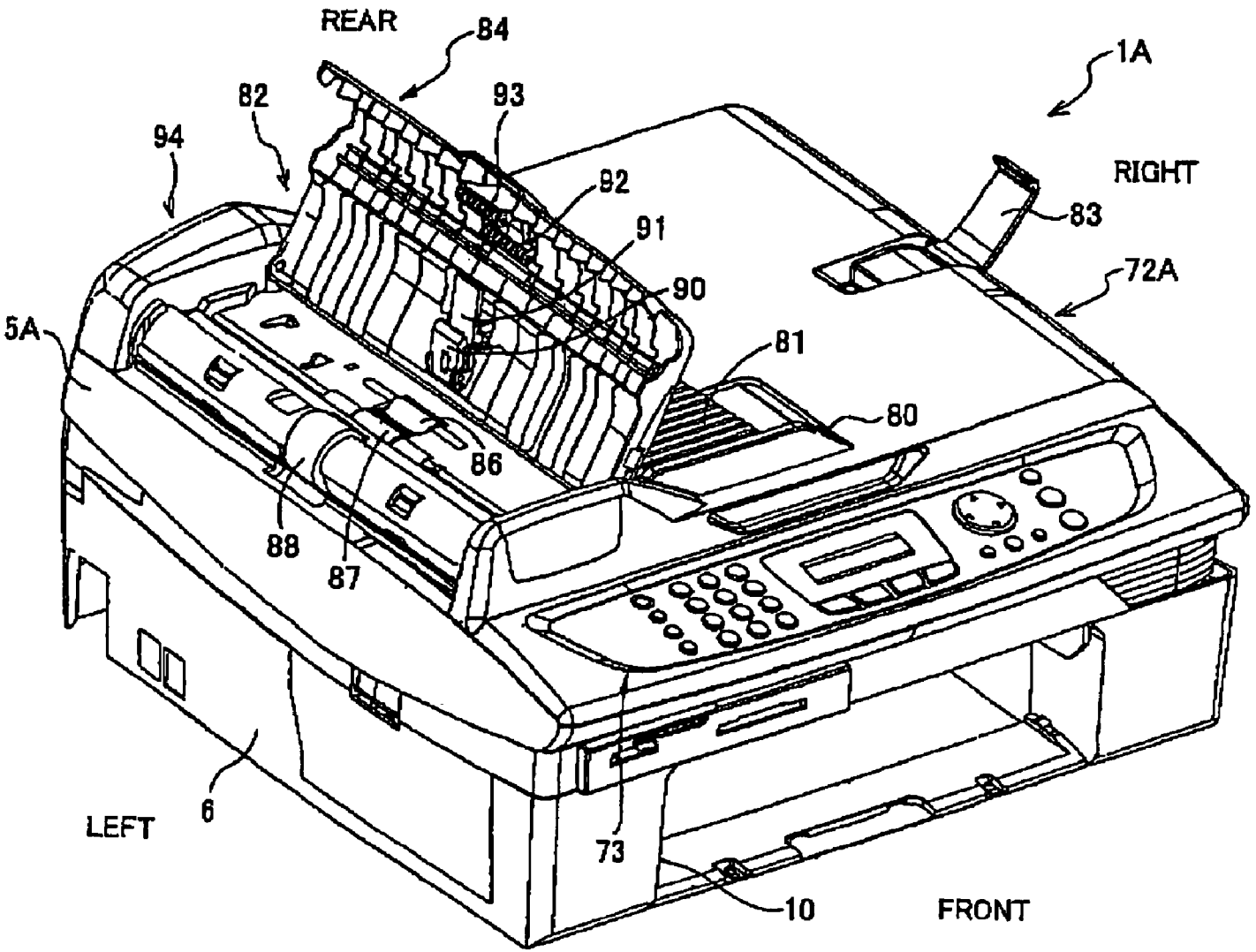
FIG. 15 is a perspective view of the multifunctional device of FIG. 14 in which a cover is in an open state.
Figure 16:
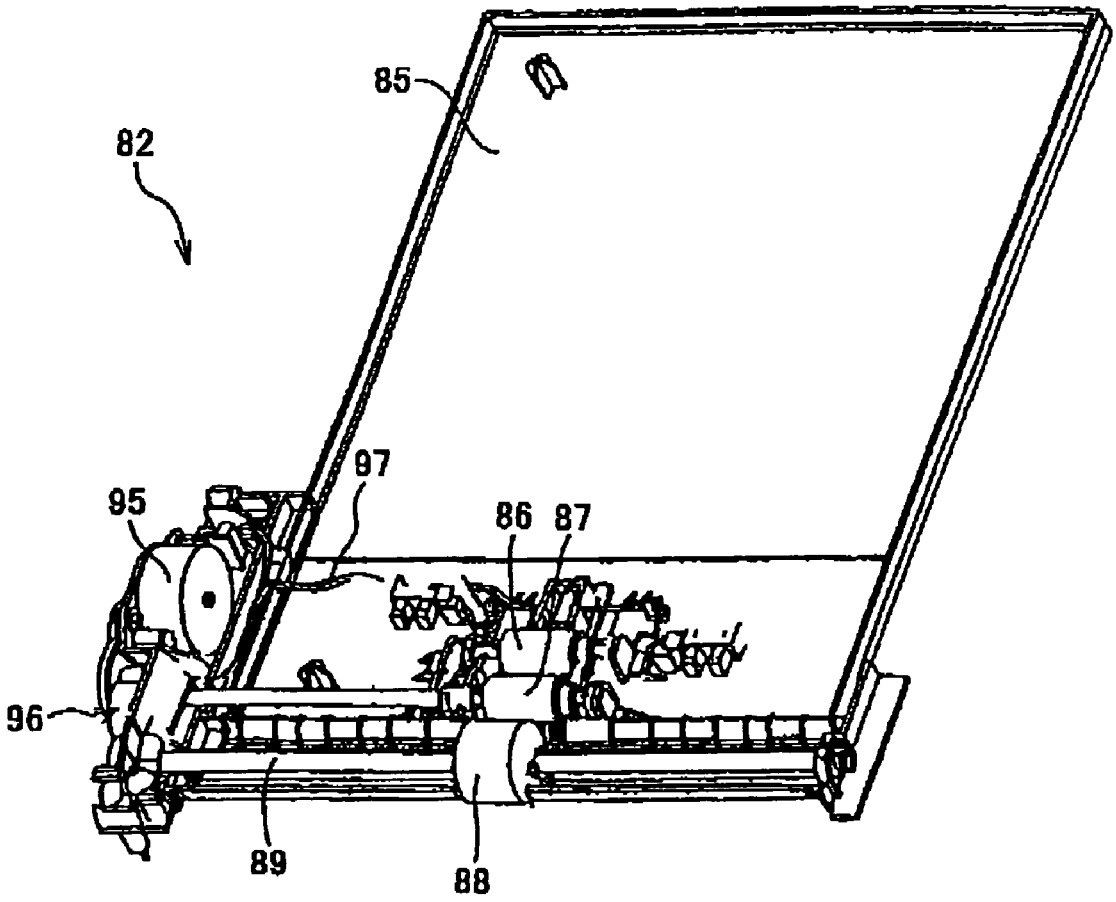
FIG. 16 is a perspective view showing the relevant parts of an automatic feeding mechanism of the multifunctional device of FIG. 14.

More specifically, as shown in FIGS. 15 and 16, the automatic document feeder 82 includes a cover 84, a pressing plate 85, a pickup roller 86, a separation roller 87, and a reversing roller 88. The cover 84 is disposed at the left end of the document cover 72A to be freely opened and closed. The pressing plate 85 is disposed above the glass plate 70 (see FIG. 6) for pressing an original document against the glass plate 70. The pickup roller 86 and the separation roller 87 are rotatably supported on the pressing plate 85 for feeding original documents one at a time inside the cover 84. The reversing roller 88 is for reversing the feeding direction of original documents fed inside the cover 84, and is rotatably supported on the cover 72A via a drive shaft 89.

As shown in FIG. 15, provided on the inner surface of the cover 84 are pad members 90 and 91 capable of resiliently contacting the pickup roller 86 and the separation roller 87, respectively, and follow rollers 92 and 93 capable of resiliently contacting the reversing roller 88.

A casing 94 is disposed behind the cover 84. As shown in FIG. 16, the casing 94 houses a document feeding motor 95 and a gear mechanism 96. The document feeding motor 95 is connected to the main control board 50 via a cable 97. The gear mechanism 96 is for transferring the rotational drive force of the document feeding motor 95 to the pickup roller 86, the separation roller 87, and the drive shaft 89. The rotational driving force transferred from the document feeding motor 95 drives the pickup roller 86 and the separation roller 87 to rotate and feed an original document from the document supply tray 80 into the cover 84 one sheet at a time. The document feeding motor 95 also drives the reversing roller 88 to rotate. The reversing roller 88 inverts the document fed by the pickup roller 86 and the separation roller 87 and changes the direction in which the document is conveyed from a leftward direction to a rightward direction. The scanning unit 71 disposed at a scanning position below the reversing roller 88 scans the image on the original document. After being scanned, the document is discharged onto the discharge tray 81.

Since the document feeding motor 95 is disposed near the pivotal axis of the upper frame 5A at the left end of the upper frame 5A, an unreasonable force is not applied to a wiring member (not shown) connecting the document feeding motor 95 and the main control board 50 (FIG. 6) and the cable 97 connecting the document feeding motor 95 to the power supply unit 60 (see FIG. 9) when the upper frame 5A is pivoted on the lower frame 6, thereby minimizing the potential for damage to the wiring member and the cable 97. Further, since the document feeding motor 95 is disposed on the rear edge of the multifunctional device 1A, opposite the side on which the main control board 50 is disposed, adverse effects of noise generated by the document feeding motor 95 on the main control board 50 can be minimized.

Note that in the multifunctional devices 1 and 1A described above, the sheet supply tray 11 mounted on the sheet accommodating section 10 also functions as a discharge tray, wherein the recording sheet P supplied from the lower supply space 12*a* on the front is reversed in the lower frame 6 and discharged into the upper discharge space 12*b* on the front. However, the sheet supply tray 11 may also be configured of only the upper discharge space 12*b* in the sheet accommodating section 10, such that the recording sheet P is supplied from the rear and discharged into the upper discharge space 12*b* on the front, for example.

Further, it is not necessary to omit the bottom surface of the sheet accommodating section 10 to form an opening in the bottom.

Further, the positions of the cartridge holder 41 and the power supply unit 60 on the right and left sides of the sheet accommodating section 10 may be switched. However, when the cartridge holder 41 is configured so that the ink cartridges 40 are mounted and removed through the top thereof, as in the multifunctional device 1 of the preferred embodiment described above, the cartridge holder 41 is preferably disposed on the side opposite the pivotal axis of the upper frame 5 in order to facilitate this replacement operation. However, if the ink cartridges 40 are mounted and removed through the front or rear side, the cartridge holder 41 may be disposed on either the left or right side of the sheet accommodating section 10.

Next, a multifunctional device 1B according to a second embodiment of the present invention will be described with reference to FIGS. 17 to 21, wherein like parts and components have been given the same reference numerals to avoid duplicating description.

Figure 19:
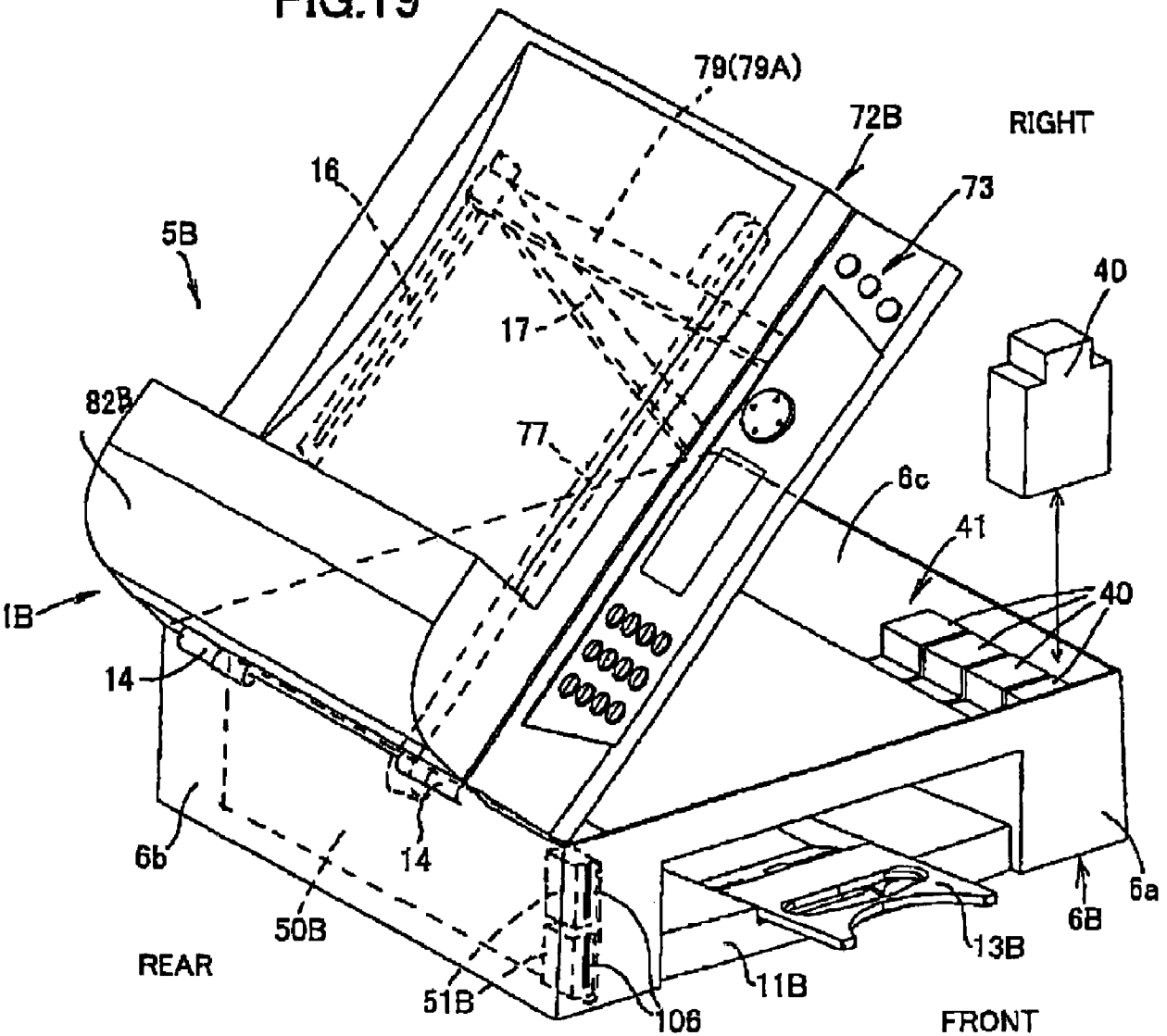
FIG. 19 is a perspective view of the multifunctional device of FIG. 17 with the upper frame in an open state.
Figure 21:
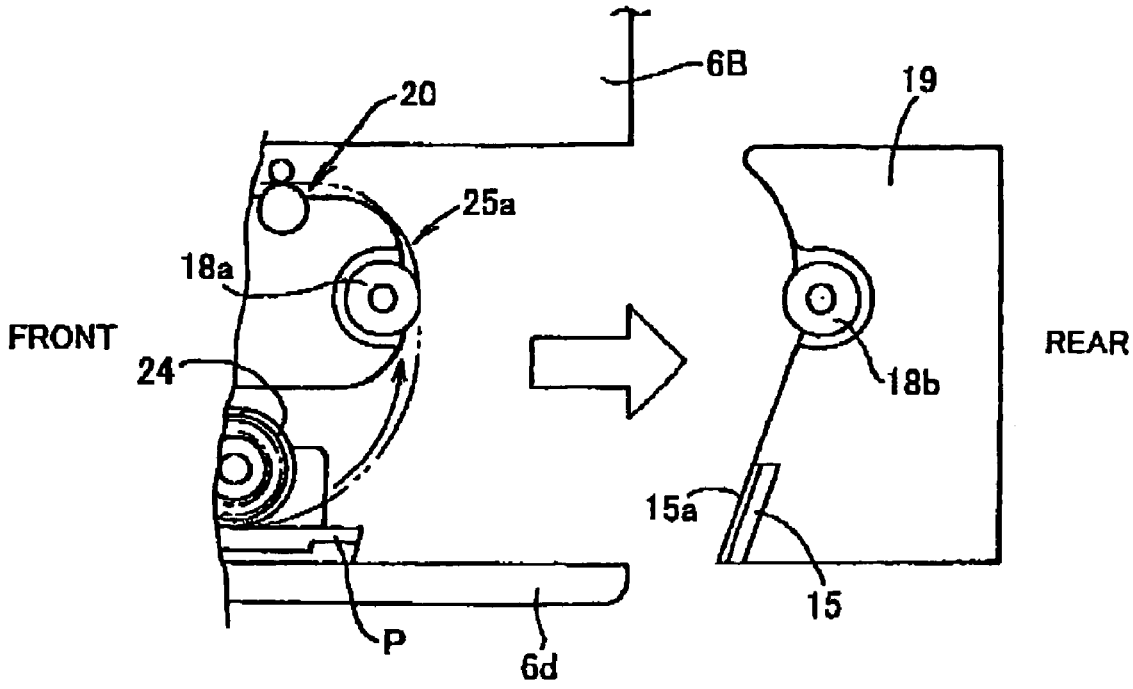
FIG. 21 is a side view of the multifunctional device of FIG. 17 with a rear cover in a detached state.

As shown in FIG. 19, the multifunctional device 12 includes an upper frame 5B and a lower frame 6B. The lower frame 6B is formed in an open-top box shape and includes a front plate 6*a*, side plates 6*b*, 6*c*, and a bottom plate 6*d* (FIG. 21). The upper frame 5B is pivotably supported by the side plate 6*b* via the shafts 14. The rear end of the bottom frame 6B is covered with a rear cover 19 shown in FIG. 21.

Figure 17:
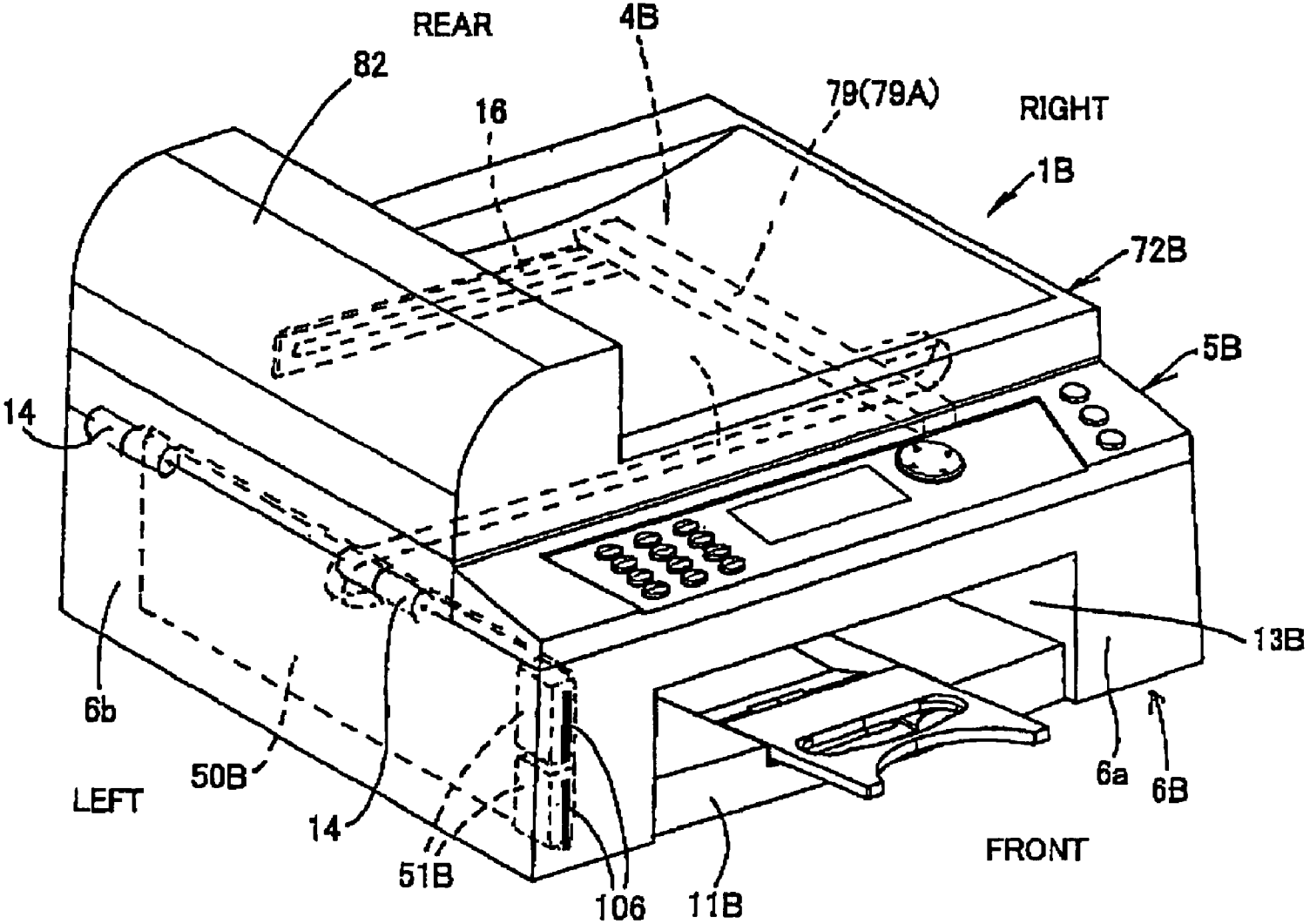
FIG. 17 is a perspective view of a multifunctional device according to a second embodiment of the present invention.

As shown in FIG. 17, a sheet supply tray 11B is disposed in the left-to-right center region of the lower frame 6B and accommodates a stack of recording sheets P. The sheet supply tray 11B can be pulled out from the front surface of the lower frame 6B.

Figure 18:
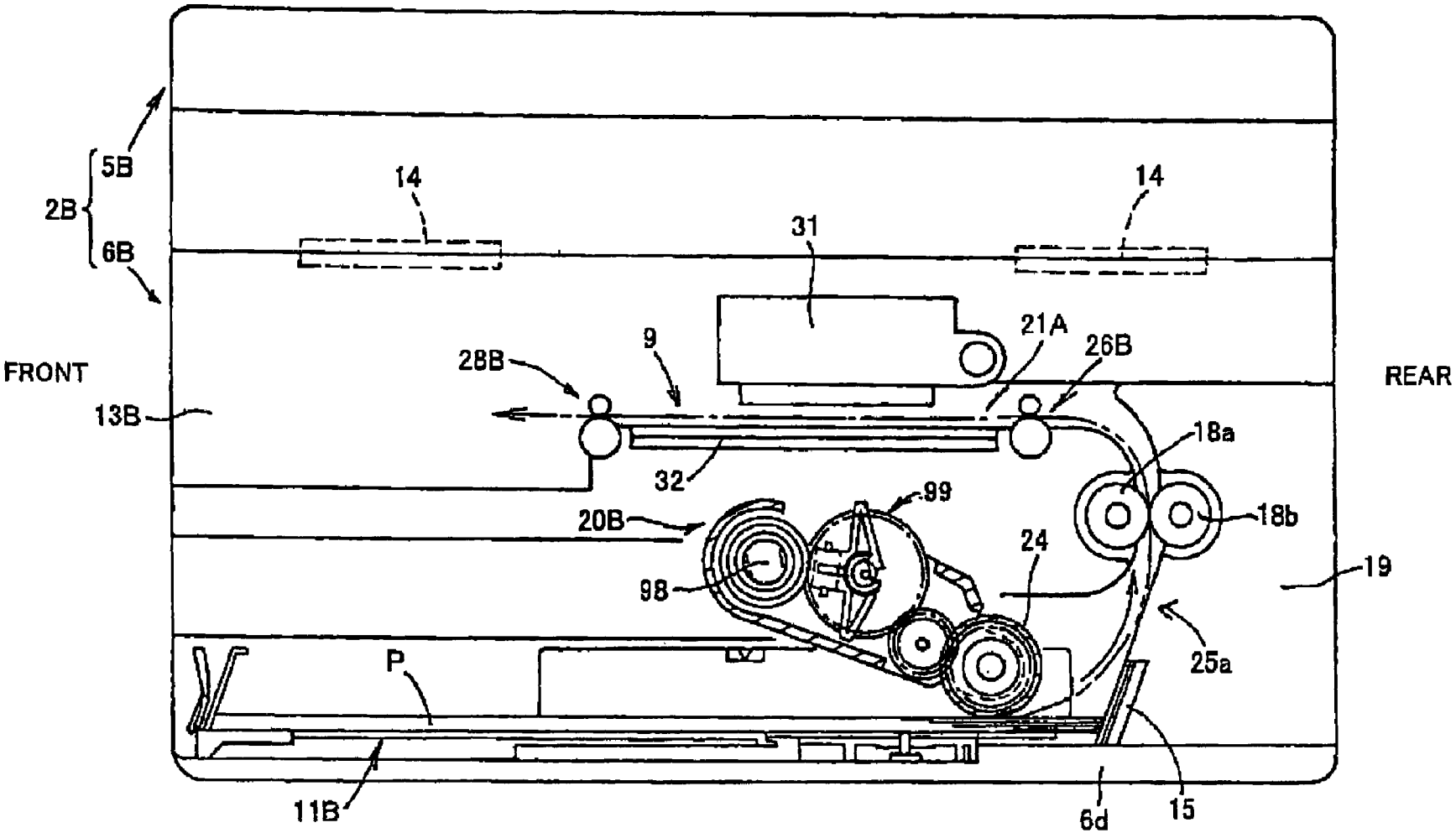
FIG. 18 is a cross-sectional side view of the multifunctional device of FIG. 17.

Further, as shown in FIG. 18, disposed inside the lower frame 6B are a conveying mechanism 20B, a U-shaped conveying part 25*a*, a conveying path 9, and a recording section 21A. The conveying mechanism 20B includes a supply roller 24, a drive shaft 98, a gear mechanism 99, a separation plate 15, and a discharge section 13B. The recording section 21A includes a flat platen 32 and an inkjet head 31 for forming color images on a sheet P supported on the platen 32 by ejecting ink thereon.

The supply roller 24 is disposed above the supply tray 11B and driven to rotate in a counterclockwise direction in FIG. 18 by the gear mechanism 99. The drive shaft 98 is rotated by a drive motor via a gear mechanism (not shown). A casing for the conveying mechanism 20B is rotatable with respect to the drive shaft 98.

The U-shaped conveying part 25*a* is disposed in the rear section of the lower frame GB and is formed in the shape of a sideways "U" letter. A conveying roller 18*a* and a follow roller 18*b* are disposed in the U-shaped conveying part 25*a*. The conveying roller 18*a* and the follow roller 18*b* are maintained in contact with one another with an appropriate amount of pressure. The conveying path 9 is formed to convey the recording sheet P forward in a substantially horizontal state. Along the conveying path 9 are provided the platen 32, a pair of registration rollers 26B disposed upstream of the platen 32 in the sheet conveying direction, and a pair of discharge rollers 28B disposed downstream of the platen 32 in the sheet conveying direction. The discharge rollers 28B are a driven discharge roller and a spur.

The separating plate 15 has a banked surface with a large frictional coefficient. The discharging section 13B is formed as an opening in the front surface of the lower frame 6B above the sheet supply tray 11B (see FIG. 17).

When the supply roller 24 rotates, the topmost one of the recording sheets P stacked in the sheet supply tray 11B is separated by the separating plate 15 and fed between the conveying roller 18*a* and the follow roller 18*b*.

After the inkjet head 31 has recorded a prescribed image on the top surface of the recording sheet P, the recording sheet P is discharged to the discharging section 13B.

As shown in FIG. 17, media slots 106 are formed as longitudinal openings in the left side of the front plate 6*a* (farther left from the discharging section 13B). The media slots 106 accept the insertion of an external storage medium capable of storing image data or the like, such as a SmartMedia (registered trademark) card, a CompactFlash (registered trademark) card, a Memory Stick (registered trademark), or a SD Card, XD Card, or the like. A main control board 50B having connectors 51B that connect to the media slots 106 is disposed near the inner surface of the side plate 6*b* and substantially parallel thereto.

As shown in FIG. 19, a cartridge holder 41 is disposed near the inner surface of the side plate 6*c* inside the lower frame 6B. Ink cartridge 40 being mounted into the cartridge holder 41 from above.

As shown in FIG. 17, the multifunctional device 1B further includes a scanner 4B. The scanner 4B includes a flatbed scanning unit and an automatic scanning unit. The flatbed scanning unit functions to scan an image from an original document placed on a large glass plate (not shown; a second glass plate described later). The construction of the flatbed scanning unit is nearly identical to the scanner 4 described in the first embodiment. Therefore, a detailed description of the flatbed scanning unit has been omitted. The automatic scanning unit is for scanning images from an original document fed by an automatic document feeder 82B.

Figure 20:
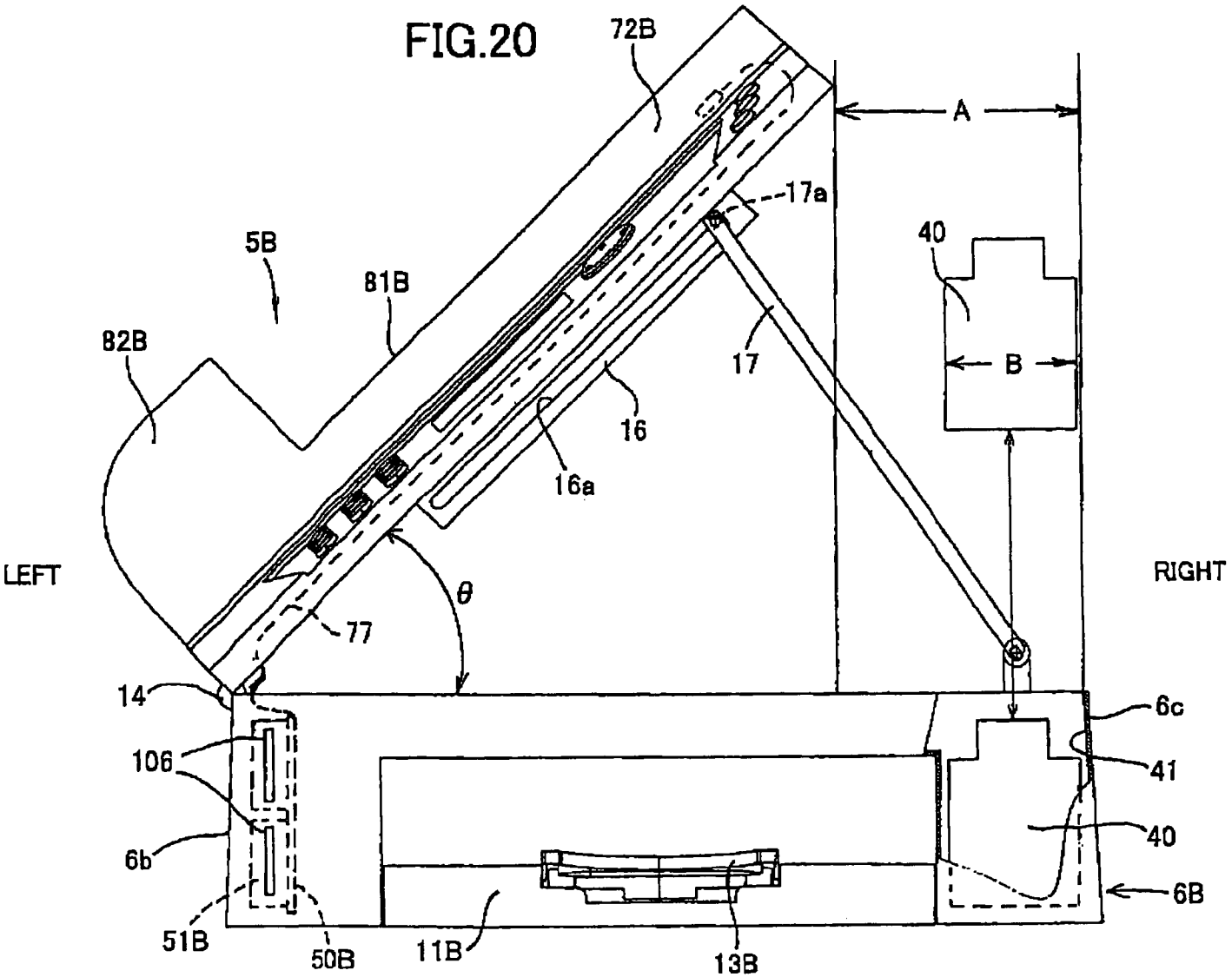
FIG. 20 is a front view of the multifunctional device of FIG. 17 with the upper frame in an open state.

A discharging unit 81B shown in FIG. 20 is formed on the top surface of the document cover 72B for receiving an original document that is discharged after being supplied by the automatic document feeder 82B and scanned. A document cover 72B may be configured to pivot open and closed on the rear surface of the multifunctional device 1B about hinges or may be configured to pivot open and closed about an axis parallel to the shafts 14.

Although not shown in the drawings, the multifunctional device 1B further includes a first glass plate that contacts the image surface of original documents fed by the automatic document feeder 82B, and the second glass plate having a larger surface area than the first glass plate for contacting the image surface of original documents laid flat in a static position. The first and second glass plates are disposed parallel to one another, but separated in the right-to-left direction which is orthogonal to the document conveying direction. The bottom surfaces of the glass plates are linked by a guide rail extending in the right-to-left direction. The first glass plate is disposed near the shafts 14. The standby position of the contact image sensor 79 for scanning an image with the flatbed scanning unit is set directly below the first glass plate. The contact image sensor 79 remains in this standby position when images are scanned with the automatic scanning unit. With this construction, the standby position of the heavy contact image sensor 79 is set near the pivotal axis of the upper frame 5B, enabling the upper frame 5B to be opened with little force.

As shown in FIG. 17, the main control board 50B is connected to the image sensor 79 by the flexible wiring member 77. Specifically, one end of the wiring member 77 is connected to a mid-portion of the image sensor 79 in the longitudinal direction, while the other end is connected to the upper edge of the main control board 50B. With this configuration, the widthwise surface of the wiring member 77 at a midpoint in the longitudinal direction does not twist, and an unreasonable force is not applied to the wiring member 77, even when the multifunctional device 1B is used over a long period of time and the upper frame 5B is repeatedly opened and closed. This makes it possible to minimize the potential for damage to the wiring member 77.

Further, since the main control board 50B is positioned near the shafts 14 and the wiring member 77 is laid out so as to curve near the shaft 14 without its widthwise surface twisting, the mid-portion of the wiring member 77 does not incur an unreasonable bending force.

Further, unused space in the lower frame 6B near the shafts 14 can be effectively used for accommodating the main control board 50B.

By integrally combining a circuit for controlling the storage medium on the main control board 50B rather than forming separate control boards, labor and costs required to run the wiring and mount the extra board can be greatly reduced. At the same time, the space required for accommodating the main control board 50B is reduced, enabling the development of a more compact multifunctional device 1B.

Next, the rear cover 19 will be described. The rear cover 19 is detachably inserted into the rear side of the lower frame 6B. The widthwise dimension of the rear cover 19 may be equal to or shorter than the widthwise dimension of the lower frame 6B on the rear surface side.

More specifically, as shown in FIG. 21, the follow roller 18*b* is rotatably disposed on the inside of the rear cover 19, and the rear cover 19 is fitted between the lower frame 6B and the bottom plate 6*d*. One side of the U-shaped conveying part 25*a* can be exposed by pulling the rear cover 19 from the rear surface of the lower frame 6B in a substantially horizontal direction. Since the follow roller 18*b* rotates on the inside of the rear cover 19, a considerable space can be opened between the conveying roller 18*a* and the follow roller 18*b* by pulling out the rear cover 19, greatly facilitating operations for removing jammed recording sheet P.

The separating plate 15 is also mounted on the inside of the rear cover 19. Hence, by pulling the rear cover 19 out of the rear surface of the lower frame 6B, a sheet jammed between the supply roller 24 and the separating plate 15 can be easily removed and operations for maintaining a surface 15*a* of the separating plate 15 or for replacing the separating plate 15 are facilitated.

Figure 22:
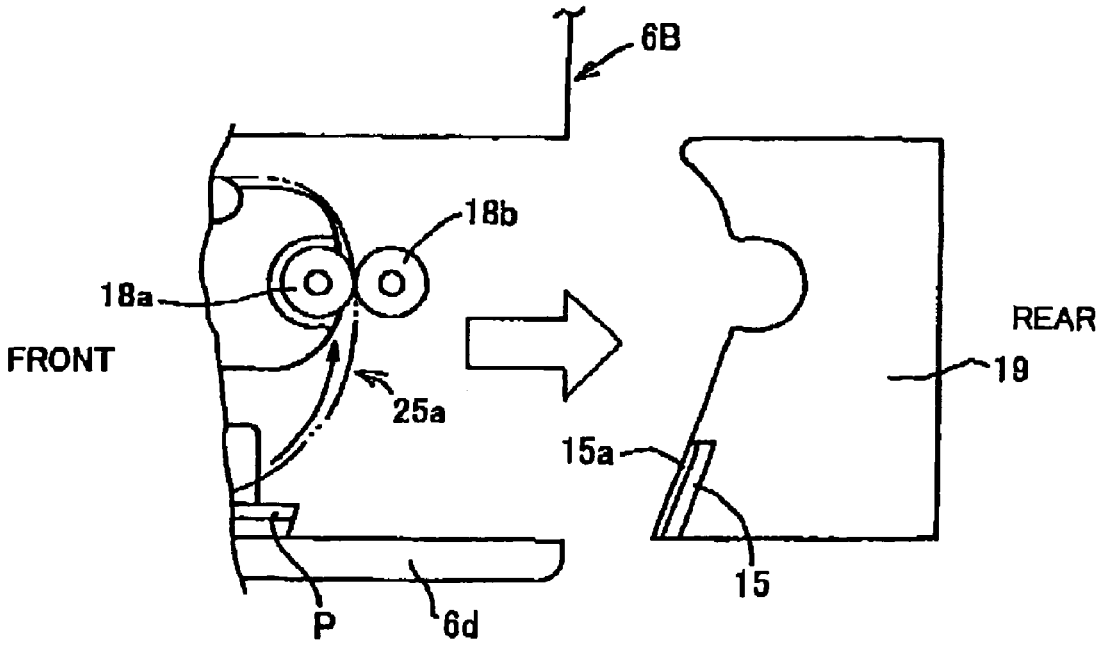
FIG. 22 is a side view showing a rear cover according to a modification of the second embodiment.

Note that as shown in FIG. 22, the conveying roller 18*a* and the follow roller 18*b* could be configured to remain inside the lower frame 6B when the rear cover 19 is removed. This simplifies the construction of the rear cover 19, since the rotating portion for the follow roller 18*b* need not be provided in the rear cover 19.

Figure 23:
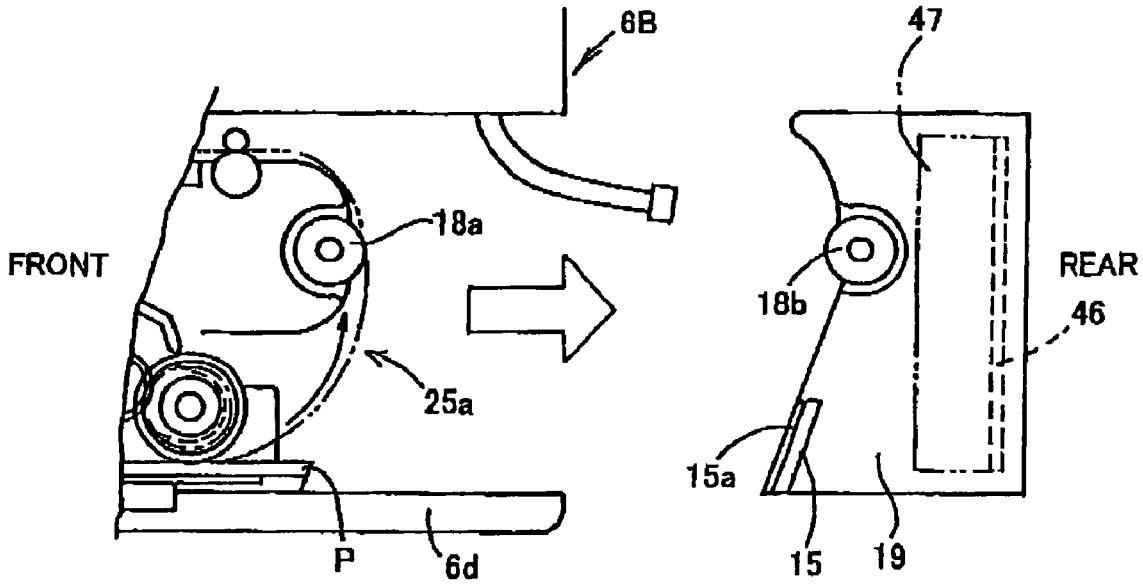
FIG. 23 is a side view showing a rear cover according to a modification of the second embodiment.

Further, as shown in FIG. 23, a power board 46 may be provided inside the rear cover 19. This construction makes effective use of space in the rear cover 19 and facilitates operations for replacing the power board 46. In this case, an inner cover 47 may also be detachably disposed in the rear cover 19 for covering the surface of the power board 46. This construction prevents the power board 46 from being exposed when the rear cover 19 is removed, thereby enabling the power board 46 to be replaced safely and preventing dust and the like from entering the power board 46. The inner cover 47 may also be formed in a curved shape to form one surface of the U-shaped conveying part 25*a*.

Figure 24:
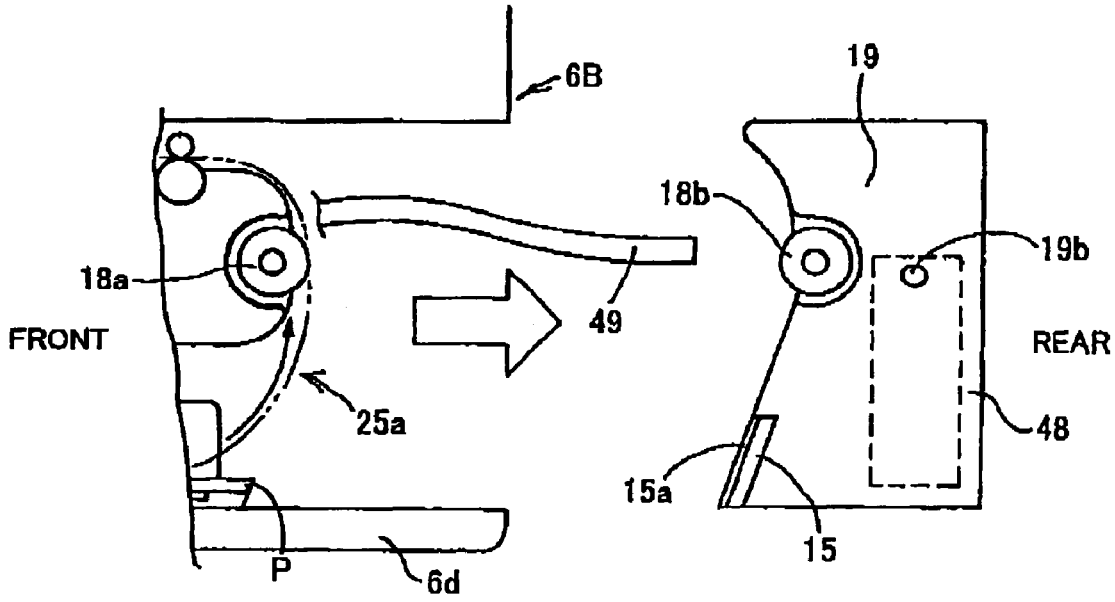
FIG. 24 is a side view showing a rear cover according to a modification of the second embodiment.

Alternatively, as shown in FIG. 24, an accumulating member 48, such as a porous fiber mat or a tank, may be disposed inside the rear cover 19 for accumulating and holding waste ink. In this example, a waste ink tube 49 may be connected to a maintenance unit (not shown) used for regularly cleaning ink from nozzles in the inkjet head 31 in a nozzle restoring process or the like, and a connecting hole 19*b* may be formed in the rear cover 19 for detachably connecting the other end of the waste ink tube 49. This construction makes effective use of space in the rear cover 19 and greatly facilitates operations for replacing the accumulating member 48.

While some exemplary embodiments of this invention have been described in detail, those skilled in the art will recognize that there are many possible modifications and variations which may be made in these exemplary embodiments while yet retaining many of the novel features and advantages of the invention.

Figure 25:
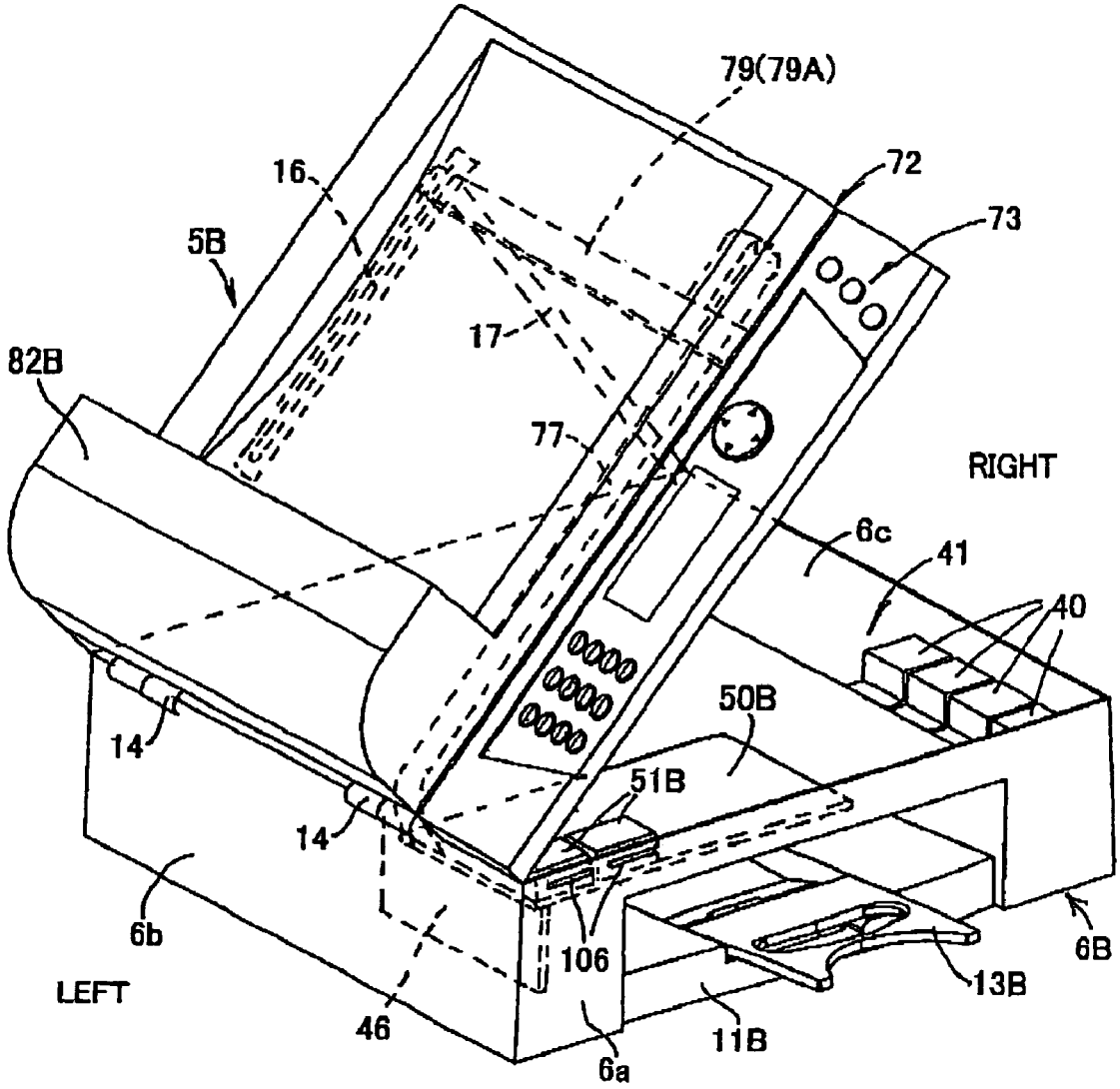
FIG. 25 is a perspective view of a multifunctional device according to a modification of the second embodiment showing the upper frame in a wide open state.

For example, as shown in FIG. 25, the media slots 106 could be formed in the front plate 6*a* of the lower frame 6B to extend in a horizontal direction, and the main control board 50B could be disposed in the lower frame 6B near the inside surface of the side plate 6*b* at a substantially horizontal orientation so that the longitudinal direction of the main control board 50 extends in the left-to-right direction of the multifunctional device 1B. The power board 46 may also be disposed in the front-to-rear direction near the inner surface of the side plate 6*b* and substantially parallel to the side plate 6*b*.

Figure 26:
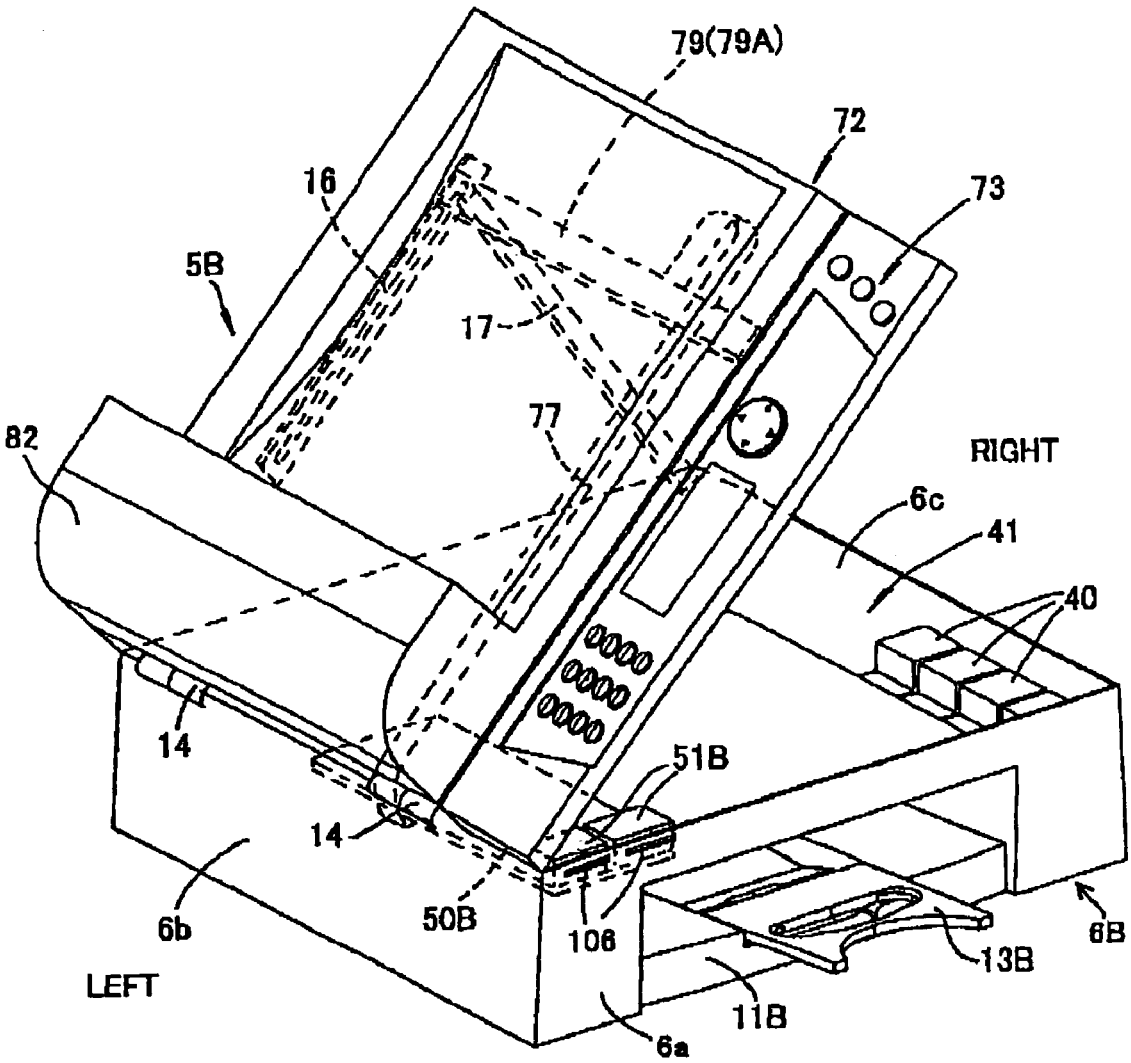
FIG. 26 is a perspective view of a multifunctional device according to a modification of the second embodiment showing the upper frame in a wide open state.

Alternatively, as shown in FIG. 26, the media slots 106 could be formed in the lower frame 6B to extend in the widthwise direction of the front plate 6*a*, and the main control board 50B could be disposed inside the lower frame 6B near the inner surface of the side plate 6*b* so that the longitudinal direction of the main control board 50B extends in the front-to-rear direction.

The shafts 14 may be disposed on the right edge of the multifunctional device rather than on the left edge thereof.

What is claimed is:

1. An image-forming device comprising:

a lower frame;

a recording unit that is disposed in the lower frame and that forms an image on a recording medium;

an upper frame capable of pivoting open and closed with respect to the lower frame about an axis extending in a first direction;

a scanning unit that is disposed in the upper frame and scans an original document while reciprocally moving in a second direction orthogonal to the first direction;

a control board having one side extending in the first direction, the control board being disposed in the lower frame;

a flexible flat cable having a predetermined width, the flexible flat cable including a first end connected to the scanning unit and a second end connected to the control board, a width direction along the entire flexible flat cable, from the scanning unit disposed in the upper frame to the control board disposed in the lower frame, being substantially parallel to the axis;

a medium holding unit that is disposed in the bottom of the lower frame and holds a recording medium;

a conveying mechanism that is disposed in the lower frame and conveys the recording medium along a conveying path;

a recording unit that is disposed in the lower frame and forms an image on the recording medium conveyed by the conveying mechanism;

a cover that is detachably mounted on the lower frame, wherein:

a part of the conveying path is shaped as a sideways U letter; and the part of the conveying path is exposed when the cover is removed from the lower frame; and a waste ink accumulating member mounted on the cover, the waste ink accumulating member storing waste ink.

2. The image-forming device according to claim 1, further comprising a replaceable member mounted on the cover.

3. The image-forming device according to claim 1, further comprising a power board mounted on the cover.

4. The image-forming device according to claim 1, further comprising a replaceable member disposed inside the cover and an inner cover that defines the part of the conveying path and that covers the replaceable member.

5. The image-forming device according to claim 1, further comprising a separating member that is disposed on the cover and separates one recording medium from a stack of recording medium held in the medium holding unit.

6. The image-forming device according to claim 1, further comprising an inkjet recording head disposed in the recording unit.

* * * * *